US011459858B2

(12) United States Patent
Sugimoto

(10) Patent No.: US 11,459,858 B2
(45) Date of Patent: Oct. 4, 2022

(54) RESOURCE COLLECTION SYSTEM

(71) Applicant: Atsushi Sugimoto, Kochi (JP)

(72) Inventor: Akitoshi Sugimoto, Kochi (JP)

(73) Assignee: Atsushi Sugimoto, Kochi (JP)

( * ) Notice: Subject to any disclaimer, the term of this patent is extended or adjusted under 35 U.S.C. 154(b) by 0 days.

(21) Appl. No.: 16/973,899

(22) PCT Filed: Jun. 12, 2019

(86) PCT No.: PCT/JP2019/023340

§ 371 (c)(1),
(2) Date: Dec. 10, 2020

(87) PCT Pub. No.: WO2019/240194

PCT Pub. Date: Dec. 19, 2019

(65) Prior Publication Data

US 2021/0348482 A1 Nov. 11, 2021

(30) Foreign Application Priority Data

Jun. 13, 2018 (JP) ..... JP2018-112773

(51) Int. Cl.
*E21B 7/14* (2006.01)
*E21B 7/18* (2006.01)
(Continued)

(52) U.S. Cl.
CPC ..... *E21B 43/01* (2013.01); *E21B 7/143* (2013.01); *E21B 7/185* (2013.01); *E21B 17/01* (2013.01);
(Continued)

(58) Field of Classification Search
CPC ..... E21B 7/143; E21B 7/185; E21B 17/01; E21B 17/20; E21B 34/06; E21B 36/00;
(Continued)

(56) References Cited

U.S. PATENT DOCUMENTS 6,978,840 B2 * 12/2005 Henderson ..... E21B 34/14 166/296
9,394,766 B2 * 7/2016 Holderman ..... E21B 34/063
(Continued)

FOREIGN PATENT DOCUMENTS

CN 103277072 A 9/2013
CN 106593349 A * 4/2017
(Continued)

*Primary Examiner* — Matthew R Buck
(74) *Attorney, Agent, or Firm* — Muncy, Geissler, Olds & Lowe, P.C.

(57) ABSTRACT

A resource collection device of a resource collection system has a resource collection pipe, a protection pipe, and a coiled tubing device. The protection pipe is disposed around the resource collection pipe and protects the resource collection pipe. The coiled tubing device is fed from a winding reel disposed on the sea surface or inside the protection pipe by way of a feeding device and penetrates a side wall of the protection pipe to extend from the interior to the exterior. The resource collection system cracks the sea floor layer by way of: supplying undiluted solutions of foaming material, fuel gas, and air containing oxygen into the sea floor layer through the coiled tubing device; mixing the undiluted solutions of foaming material together to expand in an atmosphere that includes fuel gas and air; and causing the fuel gas accumulated in the hollows of the foaming material to explosively combust.

21 Claims, 18 Drawing Sheets

(51) Int. Cl.

| | |
|---|---|
| ***E21B 17/01*** | (2006.01) |
| ***E21B 17/20*** | (2006.01) |
| ***E21B 34/06*** | (2006.01) |
| ***E21B 36/00*** | (2006.01) |
| ***E21B 37/08*** | (2006.01) |
| ***E21B 41/00*** | (2006.01) |
| ***E21B 43/01*** | (2006.01) |
| ***E21B 43/08*** | (2006.01) |

(52) U.S. Cl.
CPC ..... *E21B 17/20* (2013.01); *E21B 34/06* (2013.01); *E21B 36/00* (2013.01); *E21B 37/08* (2013.01); *E21B 41/0085* (2013.01); *E21B 41/0099* (2020.05); *E21B 43/088* (2013.01)

(58) Field of Classification Search
CPC .. E21B 37/08; E21B 41/0085; E21B 41/0099; E21B 43/01; E21B 43/088
See application file for complete search history.

(56) References Cited

U.S. PATENT DOCUMENTS

2003/0136585 A1* 7/2003 Matsuo ..... E21B 43/29 175/69
2004/0035591 A1* 2/2004 Echols ..... E21B 43/08 166/386

FOREIGN PATENT DOCUMENTS

| | | | | | |
|---|---|---|---|---|---|
| JP | 3479699 | B2 | | 12/2003 | |
| JP | 2006052395 | A | * | 2/2006 | ..... E21B 41/0099 |
| JP | 2006307481 | A | | 11/2006 | |
| JP | 2007-051508 | A | | 3/2007 | |
| JP | 4581719 | B2 | | 11/2010 | |
| JP | 2015-038296 | A | | 2/2015 | |
| JP | 5923330 | B2 | | 5/2016 | |
| WO | WO-2005056724 | A2 | * | 6/2005 | ..... C10G 32/02 |

* cited by examiner

RESOURCE COLLECTION SYSTEM

TECHNICAL FIELD

The present invention relates to a resource collection system, more particularly, to a resource collection system using a pressure-induced explosive heat and shock wave conductor and specifically relates to a resource collection system that collects, using the pressure-induced explosive heat and shock wave conductor, flammable gas such as methane gas and oil from gas-hydrate layers present in a layered state under the sea bottom.

BACKGROUND ART

Gas-hydrate considered to be most abundant in a resource amount among unconventional natural gases has been attracting tremendous attention as an energy source of the next generation. The gas-hydrate is present under a low-temperature high-pressure condition and is dissolved into gas and water by raising temperature or reducing pressure. Accordingly, there have been proposed various methods of efficiently collecting gas from the gas-hydrate layers in the sea bottom.

Patent Literature 1 states that a high-speed jet flow of a replacement filler is jetted into a gas-hydrate layer to cut and break the gas-hydrate layer and that, since a stratum void from which gas-hydrate is recovered can be filled or replaced with a replacement material such as a cement-based solidification material, a stratum and a ground after mining can be stabilized. Patent Literature 2 states that a methane-hydrate layer is heated and gas emitted from the heated entire methane-hydrate layer is recovered and that a decomposition accelerator is pressurized and injected to recover gas emitted from the entire methane-hydrate layer. Patent Literature 3 states that the seawater is heated to temperature of approximately 60° C., the hot water is supplied to a hot water pipe inserted into a drilling hole, and the hot water is jetted from a jetting hole into the drilling hole, whereby methane-hydrate is heated to a decomposition temperature or more.

CITATION LIST

Patent Literature

Patent Literature 1: Japanese Patent No. 3479699
Patent Literature 2: Japanese Patent No. 4581719
Patent Literature 3: Japanese Patent No. 5923330

SUMMARY OF INVENTION

Technical Problems

However, Patent Literature 1 has a problem in that only a portion directly hit by a high-speed jet body can be destroyed and a problem in that, even if the replacement filler is jetted at high speed, the gas-hydrate layer cannot be destroyed because the jet flow suddenly weakens. Patent Literature 2 has a problem in that the methane hydrate can be decomposed when the hot water is injected but, even if the hot water is circulated into the hole after the drilling, it takes time until the decomposition of the methane-hydrate on the hole surface advances to the depth of the frozen methane-hydrate layer and a problem in that, when a decomposition accelerator such as methanol is injected, the methane hydrate can be decomposed without changing the pressure and the temperature of the methane-hydrate layer but, even if the decomposition accelerator is pressurized and injected into the hole after the drilling, it takes time until the decomposition of the methane hydrate on the hole surface advances to the depth of the frozen methane-hydrate layer. Further, similarly, Patent Literature 3 has a problem in that it takes time until the methane hydrate is decomposed to the depth of the frozen methane-hydrate layer.

The present invention has been devised in view of such problems in the past and an object of the present invention is to provide a resource collection system that is capable of more efficiently collecting resources from a seabed layer.

In addition to the above object, another object of the present invention is to provide a resource collection system that can stably operate continuously for a time equal to or longer than in the past, can more efficiently supply necessary energy, and can be reduced in size.

Solution to Problems

As a result of earnestly repeating researches in order to achieve the objects, first, the inventor found that it is possible to more efficiently collect resources from a seabed layer by supplying liquid concentrates of a foaming material, fuel gas, and air including oxygen into the seabed layer through a coiled tubing device extending into the seabed layer, mixing the liquid concentrates of the foaming material with one another to cause the liquid concentrates to foam in an atmosphere including the fuel gas and the air, explosively burning the fuel gas accumulated in a cavity of the foaming material, and crushing the seabed layer.

The inventors found that it is possible to more efficiently collect resources from the seabed layer by providing an opening in a tube outer wall of the coiled tubing device, providing a mixing chamber on the inner side of the opening, and, after mixing the liquid concentrates of the foaming material with one another in the mixing chamber, supplying the liquid concentrates to between the seabed layer and the tube outer wall through the opening together with the fuel gas and the air, and conceived of the present invention.

That is, a first embodiment of the present invention provides a resource collection system including: a resource collection pipe for sending resources collected from a seabed layer to a collected resource storage tank; a protective pipe that is provided around the resource collection pipe and protects the resource collection pipe; and a coiled tubing device that is let out from a winding reel disposed on a sea surface or an inside of the protective pipe and extends from an inner side to an outer side piercing through a sidewall of the protective pipe. The resource collection system crushes the seabed layer by supplying liquid concentrates of a foaming material, fuel gas, and air including oxygen into the seabed layer through the coiled tubing device, mixing the liquid concentrates of the foaming material with one another to cause the liquid concentrates to foam in an atmosphere including the fuel gas and the air, and explosively burning the fuel gas accumulated in a cavity of the foaming material.

In the first embodiment, it is preferable that the coiled tubing device includes a tubular tube outer wall, an opening provided in the tube outer wall, and a mixing chamber provided on an inner side of the opening and, after mixing the liquid concentrates of the foaming material with one another in the mixing chamber, supplies a mixture of the liquid concentrates to between the seabed layer and the tube outer wall through the opening together with the fuel gas and the air.

It is preferable that the foaming material formed by mixing the liquid concentrates of the foaming material with one another includes conductor metal or a carbon nanotube and the resource collection system ignites the fuel gas accumulated in the cavity of the foaming material by applying a high voltage to between the foaming material having conductivity and an ignition wire exposed to the tube outer wall or the mixing chamber and electrically insulated.

It is preferable that the resource collection system ignites the fuel gas accumulated in the cavity of the foaming material by applying a high voltage to an ignition plug provided in the tube outer wall or the mixing chamber.

It is preferable that the resource collection system cleans the mixing chamber using at least one of high-pressure water and high-pressure air.

A second embodiment of the present invention provides a resource collection system including: a high-pressure water supply pipe for supplying high-pressure water into a seabed layer in order to collect resources from the seabed layer; and a resource collection pipe for sending the resources collected from the seabed layer to a collected resource storage tank. The resource collection system mixes a crushed particle in the high-pressure water in the high-pressure water supply pipe and crushes the seabed layer with the high-pressure water mixed with the crushed particle. The crushed particle is obtained by coating an outer side of a cement particle with a slow-acting heat generating body, an expanding body, and a fast-acting heat generating body in order. The slow-acting heat generating body is obtained by baking, with a microwave, a material that absorbs moisture of the high-pressure water and generates heat. The expanding body is formed by a material that absorbs the moisture of the high-pressure water and expands. The fast-acting heat generating body is obtained by baking, with the microwave, a same material as the slow-acting heat generating body for a shorter time than the slow-acting heat generating body or not baking the material with the microwave.

A third embodiment of the present invention provides a resource collection system including: a resource collection pipe for sending resources collected from a seabed layer to a collected resource storage tank; a protective pipe that includes a sidewall provided around the resource collection pipe and a plurality of sidewall holes piercing through the sidewall and protects the resource collection pipe; a filter that is disposed on an inside of the protective pipe and removes sediment excavated from the seabed layer; and a gate pipe disposed at least one of on an outer side of the protective pipe and between the protective pipe and the filter in order to open and close the plurality of sidewall holes. The resource collection system opens the plurality of sidewall holes when collecting the resources from the seabed layer and closes the plurality of sidewall holes at times other than when collecting the resources.

In the third embodiment, it is preferable that the resource collection system opens the plurality of sidewall holes after raising pressure on an inner side of the protective pipe to a same pressure as pressure of the seabed layer on an outer side of the protective pipe.

It is preferable that the resource collection system prevents freezing of seawater between the protective pipe and the gate pipe pressure hot water or high-pressure steam into and in the plurality of sidewall holes by feeding high-pressure hot water or high-pressure steam through at least one of a through-hole or a spiral through-hole in an axial direction of the sidewall of the protective pipe and a through-hole or a spiral through-hole in an axial direction of a sidewall of the gate pipe.

It is preferable that a coating agent is mixed in the high-pressure water and, in a state in which the plurality of sidewall holes are closed, the resource collection system coats the filter by feeding the high-pressure water mixed with the coating agent in a same direction as a direction in which the resources flow in the filter when the resources are collected.

It is preferable that, in a state in which the plurality of sidewall holes are closed, the resource collection system cleans an inside of the filter by feeding the high-pressure water in an opposite direction of a direction in which the resources flow in the filter when the resources are collected.

Further, it is preferable that, in the state in which the plurality of sidewall holes are closed, the resource collection system cleans a surface of the filter by feeding high-pressure hot water or high-pressure steam to the surface of the filter.

Further, it is preferable that the resource collection system further includes: a secondary protective pipe including a secondary sidewall disposed on an inner side of the filter and a plurality of secondary sidewall holes piercing through the secondary sidewall; a secondary filter that is disposed on an inside of the secondary protective pipe and removes sediment excavated from the seabed layer; and a secondary gate pipe disposed at least one of between the filter and the secondary protective pipe and between the secondary protective pipe and the secondary filter in order to open and close the plurality of secondary sidewall holes.

It is preferable that the protective pipe includes a semi-spherical bottom wall extending from one end of the sidewall and a plurality of bottom wall holes piercing through the bottom wall.

A fourth embodiment of the present invention provides a resource collection system including: a resource collection pipe for sending resources collected from a seabed layer to a collected resource storage tank; a protective pipe that is provided around the resource collection pipe and protects the resource collection pipe; and a coiled tubing device let out from a winding reel disposed on a sea surface or on an inside of the protective pipe and extending from an inner side to an outer side piercing through a sidewall of the protective pipe. The coiled tubing device includes a sub resource collection pipe for sending the resources collected from the seabed layer to the collected resource pipe; a sub protective pipe that includes a sub sidewall provided around the sub resource collection pipe and a plurality of sub sidewall holes piercing through the sub sidewall and protects the sub resource collection pipe; a sub filter that is disposed on an inside of the sub protective pipe and removes sediment excavated from the seabed layer; and a sub gate pipe disposed at least one of on an outer side of the sub protective pipe and between the sub protective pipe and the sub filter in order to open and close the plurality of sub sidewall holes.

In the fourth embodiment, it is preferable that a plurality of the coiled tubing devices are disposed in at least one position with respect to an axial direction of the protective pipe at a predetermined interval in a circumferential direction of the positions.

A fifth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The resource collection system pushes out, using a high-pressure pump, the sediment removed by the filter from an opening of a sidewall of the protective pipe toward the seabed layer.

A sixth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The protective pipe is disposed with an axial direction directed vertically with respect to a sea surface. The resource collection pipe includes a gas collection pipe connected to a gas storage chamber provided above the filter and an oil collection pipe connected to an oil storage chamber provided below the filter. The filter includes a resource collection hole piercing through the filter in a longitudinal direction and, among the resources having passed through the filter from an outer side toward an inner side and reached the resource collection hole, the resource collection system raises gas to the gas storage chamber and drops oil to the oil storage chamber.

A seventh embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The filter includes a plurality of columnar elements. The elements are disposed in at least one position with respect to a longitudinal direction at a predetermined interval in a circumferential direction of the positions.

An eighth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The resource collection system prevents freezing of seawater on a surface or an inside of the filter by feeding high-pressure hot water or high-pressure steam into a through-hole in a longitudinal direction of the filter.

A ninth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The filter includes a permanent magnet disposed to hold diatomaceous earth with magnetic body powder on an inside of an element and demagnetizing means for weakening a holding force for the diatomaceous earth with magnetic body powder by the permanent magnet. The resource collection system reduces an amount of the diatomaceous earth with magnetic body powder held by the permanent magnet by actuating the demagnetizing means.

In the ninth embodiment, it is preferable that the demagnetizing means is an electromagnet coil disposed on an inner side or an outer side of the permanent magnet such that poles opposite to poles of the permanent magnet are respectively adjacent to the poles, and the resource collection system reduces the amount of the diatomaceous earth with magnetic body powder held by the permanent magnet by energizing the electromagnet coil.

A tenth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The filter includes an electromagnet coil disposed to hold diatomaceous earth with magnetic body powder on an inside of an element. The resource collection system generates a holding force for the diatomaceous earth with magnetic body powder by the electromagnet coil by energizing the electromagnet coil.

An eleventh embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The filter includes a spiral metal wire and a column extending in a straight-axis direction of the spiral metal wire and fixed to the spiral metal wire. The resource collection system prevents freezing of seawater on a surface of the spiral metal wire by feeding high-pressure hot water or high-pressure steam into a through-hole or a spiral through-hole of the spiral metal wire in a longitudinal direction of the column.

A twelfth embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. The power supply device includes a jet turbine. The jet turbine is driven by combustion gas generated by burning the resources collected from the seabed layer in a combustion chamber and supplies high-pressure hot water or high-pressure steam to the circulating flow generation pipe.

A thirteenth embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. The power supply device includes a turbine. The turbine is driven by combustion gas and steam generated by burning, with a submerged burner, the resources collected from the seabed layer and supplies high-pressure hot water or high-pressure steam to the circulating flow generation pipe.

A fourteenth embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. The power supply device is a fuel cell that supplies electric power using hydrogen obtained by causing the resources collected from the seabed layer and high-temperature steam to react.

A fifteenth embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. When an amount of the resources collected from the seabed layer decreases, the resource collection system short-circuits a channel of the circulating flow by changing an angle of movable pipes provided at both ends of the circulating flow generation pipe and jets high-pressure hot water or high-pressure steam from the movable pipes toward the seabed layer.

A sixteenth embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. When a flow rate of the circulating flow decreases, the resource collection system moves sediment in the circulating flow generation pipe in a direction of the circulating flow by rotating a spiral rotary wing.

In the sixteenth embodiment, it is preferable that, before moving the protective pipe in an axial direction with respect to the seabed layer, the resource collection system supplies cement particles into the seabed layer in two opening positions of the circulating flow generation pipe.

A seventeenth embodiment of the present invention provides a resource collection system including: a resource collection pipe for sending resources collected from a seabed layer to a collected resource storage tank; a protective pipe that is provided around the resource collection pipe and protects the resource collection pipe; and a coiled tubing device that is let out from a winding reel disposed on a sea surface or an inside of the protective pipe and extends from an inner side to an outer side piercing through a sidewall of the protective pipe. The resource collection system crushes the seabed layer by supplying liquid concentrates of a foaming material, a fuel gas generation material, high-pressure water, and air including oxygen into the seabed layer through the coiled tubing device, generating fuel gas with chemical reaction of the fuel gas generation material and the high-pressure water, mixing the liquid concentrates of the foaming material with one another to cause the liquid concentrates to foam in an atmosphere including the fuel gas and the air, and explosively burning the fuel gas accumulated in a cavity of the foaming material.

In the seventeenth embodiment, it is preferable that the fuel gas generation material is carbide particles, and the fuel gas is acetylene gas.

An eighteenth embodiment of the present invention provides a resource collection system including: a resource collection pipe for sending resources collected from a seabed layer to a collected resource storage tank; a protective pipe that is provided around the resource collection pipe and protects the resource collection pipe; and a coiled tubing device that is let out from a winding reel disposed on a sea surface or an inside of the protective pipe and extends from an inner side to an outer side piercing through a sidewall of the protective pipe. The resource collection system crushes the seabed layer by supplying liquid concentrates of a foaming material, a fuel gas generation material, high-pressure water, and air including oxygen into the seabed layer through the coiled tubing device, generating fuel gas with decomposition promotion of the seabed layer by the fuel gas generation material, mixing the liquid concentrates of the foaming material with one another to cause the liquid concentrates to foam in an atmosphere including the fuel gas and the air, and explosively burning the fuel gas accumulated in a cavity of the foaming material.

In the eighteenth embodiment, it is preferable that the fuel gas generation material is methanol, the seabed layer is a methane-hydrate layer, and the fuel gas is methane gas.

A nineteenth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The resource collection system prevents freezing of seawater on a surface and an inside of the filter by applying high-pressure hot water or high-pressure steam to the surface of the filter.

A twentieth embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The resource collection system prevents freezing of seawater on a surface and an inside of the filter by transferring heat of high-pressure hot water or high-pressure steam to the filter through heat transfer means at both ends in a longitudinal direction of the filter.

A twenty-first embodiment of the present invention provides a resource collection system including: a resource collection pipe for sending resources collected from a seabed layer to a collected resource storage tank; a protective pipe that is provided around the resource collection pipe and protects the resource collection pipe; a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe. The power supply device is a thermoelectric conversion device that converts heat of a hydrothermal deposit in the seabed layer into electric power and supplies the electric power.

A twenty-second embodiment of the present invention provides a resource collection system including: a resource collection pipe for sending resources collected from a seabed layer to a collected resource storage tank; a protective pipe that is provided around the resource collection pipe and protects the resource collection pipe; and a filter that is disposed on an inside of the protective pipe and removes sediment excavated from the seabed layer. The filter includes an object obtained by stacking and compressing fiber-like metal entangled like cotton. The resource collection system prevents freezing of seawater on a surface and an inside of the filter by feeding high-pressure hot water or high-pressure steam into a through-hole in a longitudinal direction of the filter.

Advantageous Effects of Invention

According to the present invention, the resource collection system can more efficiently collect resources from the seabed layer.

According to the present invention, in addition to the effect described above, the resource collection system can stably operate continuously for a time equal to or longer than in the past, can more efficiently supply necessary energy, and can be reduced in size.

DESCRIPTION OF EMBODIMENTS

Figure 1:
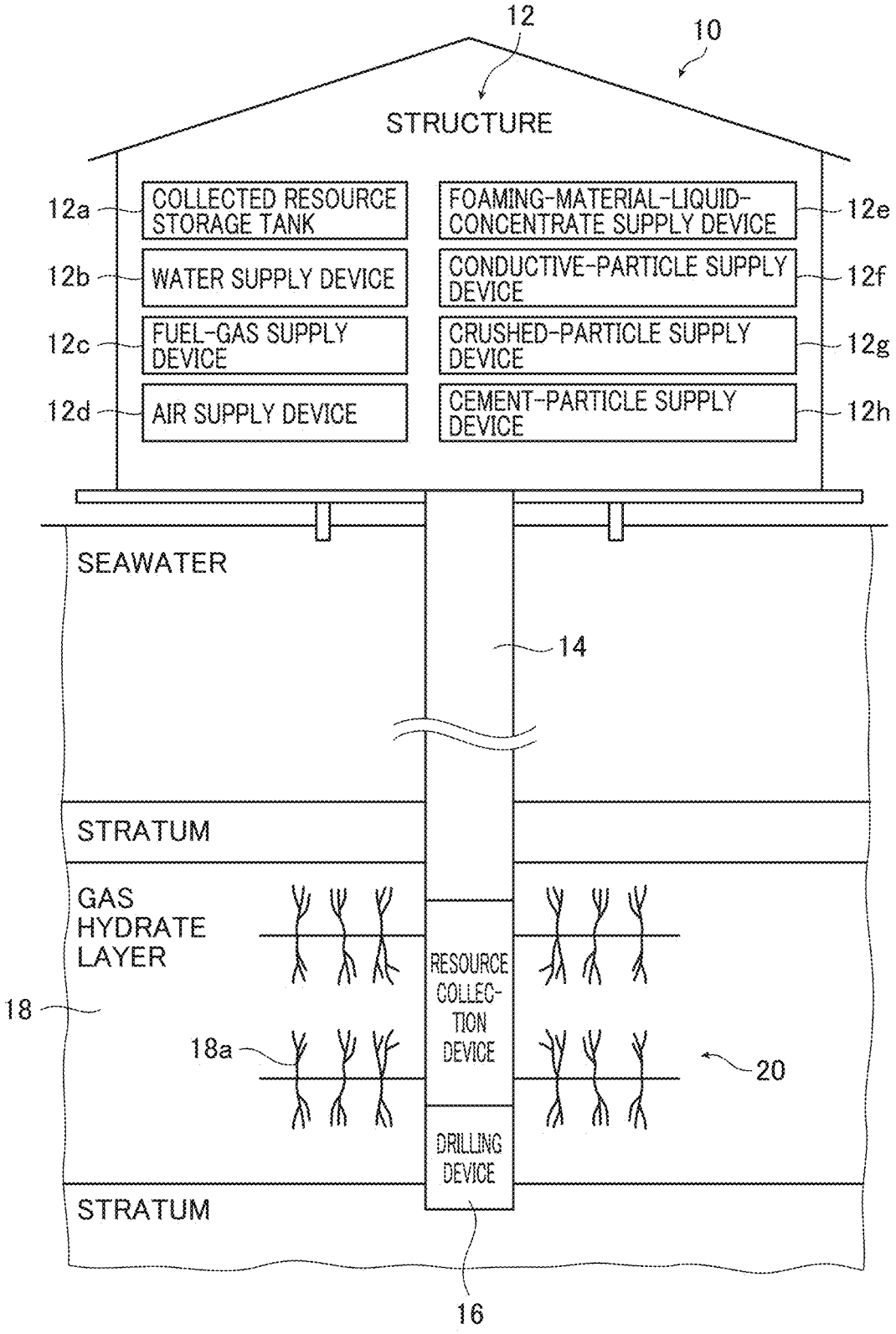
FIG. 1 is a block diagram schematically showing an overall configuration including a resource collection system in a first embodiment of the present invention.

The present invention is explained in detail below based on preferred embodiments shown in the accompanying drawings. A resource collection system of the present invention includes a resource collection system using a conductor that transmits heat and a shock wave of explosive combustion caused in a wide range by induced explosion in a place where pressure of the seawater is applied, a so-called pressure-induced explosive heat and shock wave conductor. In this specification, sediment include not only earth and sand but also mud and seawater, and high-pressure hot water or high-pressure steam used for freezing prevention and seabed layer heating includes not only one of them but also high-pressure hot water mixed with high-pressure steam. In this specification, the same components are denoted by the same reference numerals and signs and explanation of the components is omitted when the explanation is redundant. Functions of a resource collection device configuring the resource collection system of the present invention can be used in combination with one another. When a plurality of coiled tubing devices, a plurality of filters, and a plurality of power supply devices are used in one resource collection system, those different from one another among examples and modifications of each of them can be disposed in different positions and can be used in combination. Further, all driven portions (for rotation, movement in the vertical direction, movement in the horizontal direction, and movement in a curved line direction) of the resource collection device configuring the resource collection system of the present invention are driven by a liquid pressure motor including a hydraulic motor or an air motor.

First, an overall configuration including a resource collection system in a first embodiment of the present invention is explained. FIG. 1 is a block diagram schematically showing an overall configuration including a resource collection system in the first embodiment of the present invention.

An overall configuration 10 includes a structure 12 disposed on the sea surface, a connection pipe 14 extending downward from the structure 12, a drilling device 16 included in the lower end of the connection pipe 14, and a resource collection device 20 included between the connection pipe 14 and the drilling device 16. The resource collection device 20 collects resources by crushing a seabed layer 18 including a gas-hydrate layer and forming a large number of cracks 18*a*. The structure 12 includes a collected resource storage tank 12*a*, a water supply device 12*b*, a fuel-gas supply device 12*c*, an air supply device 12*d*, a foaming-material-liquid-concentrate supply device 12*e*, a conductive-particle supply device 12*f*, a crushed-particle supply device 12*g*, and a cement-particle supply device 12*h*.

Figure 2:
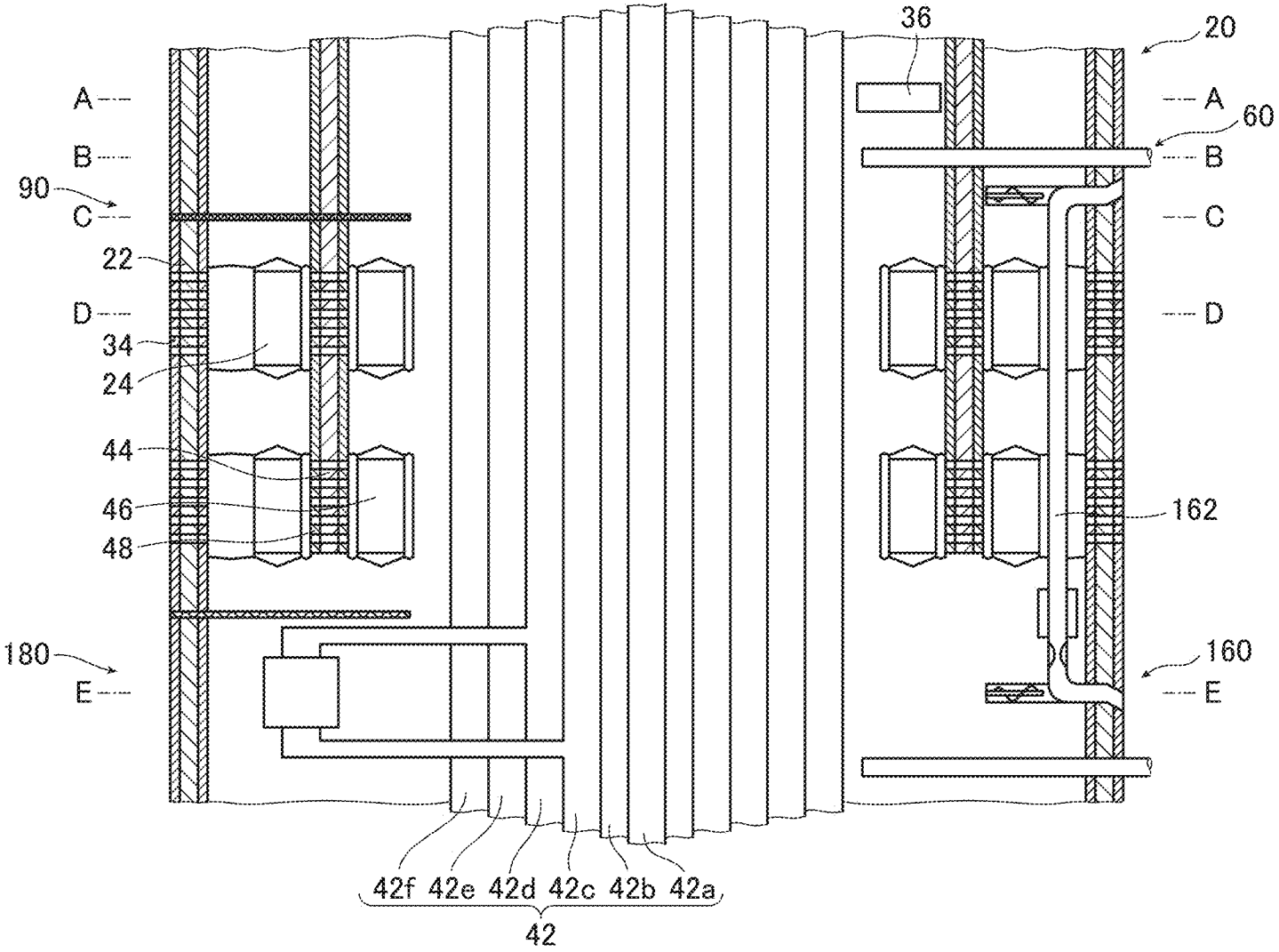
FIG. 2 is a longitudinal sectional view schematically showing a function of a resource collection device configuring the resource collection system shown in FIG. 1.
Figure 3:
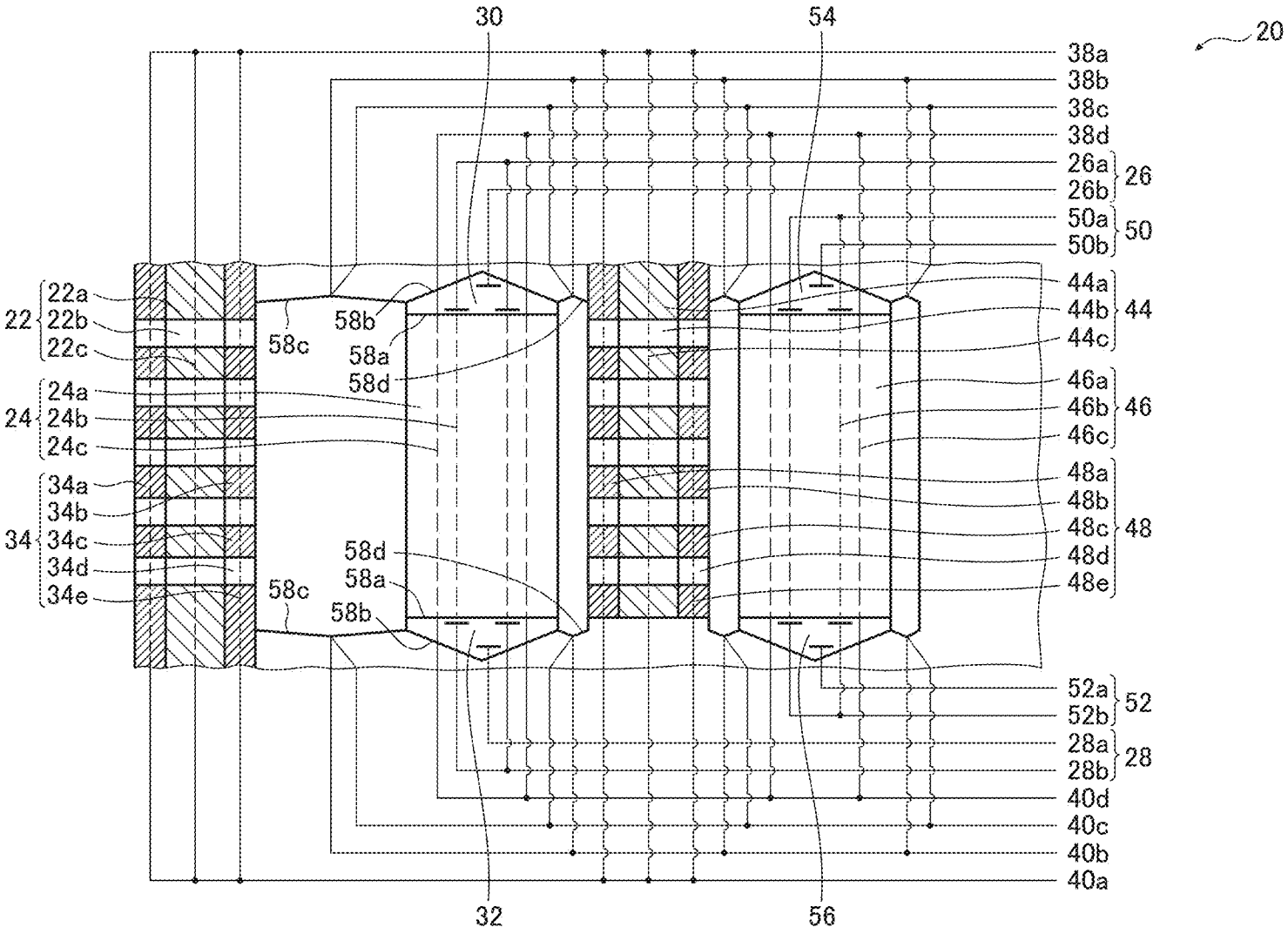
FIG. 3 is a partial longitudinal sectional view schematically showing a filter configuring the resource collection device shown in FIG. 2 and the periphery of the filter.
Figure 4:
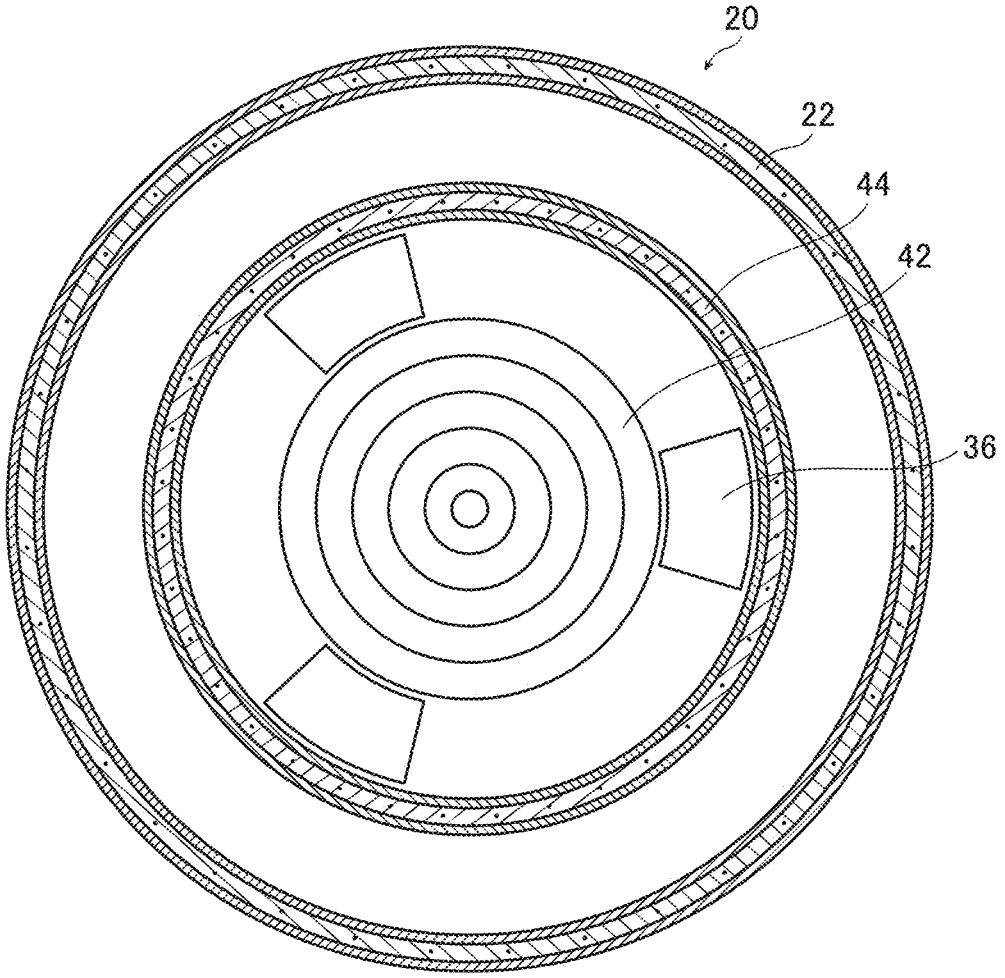
FIG. 4 is a cross sectional view in a line AA of the resource collection device shown in FIG. 2.
Figure 5:
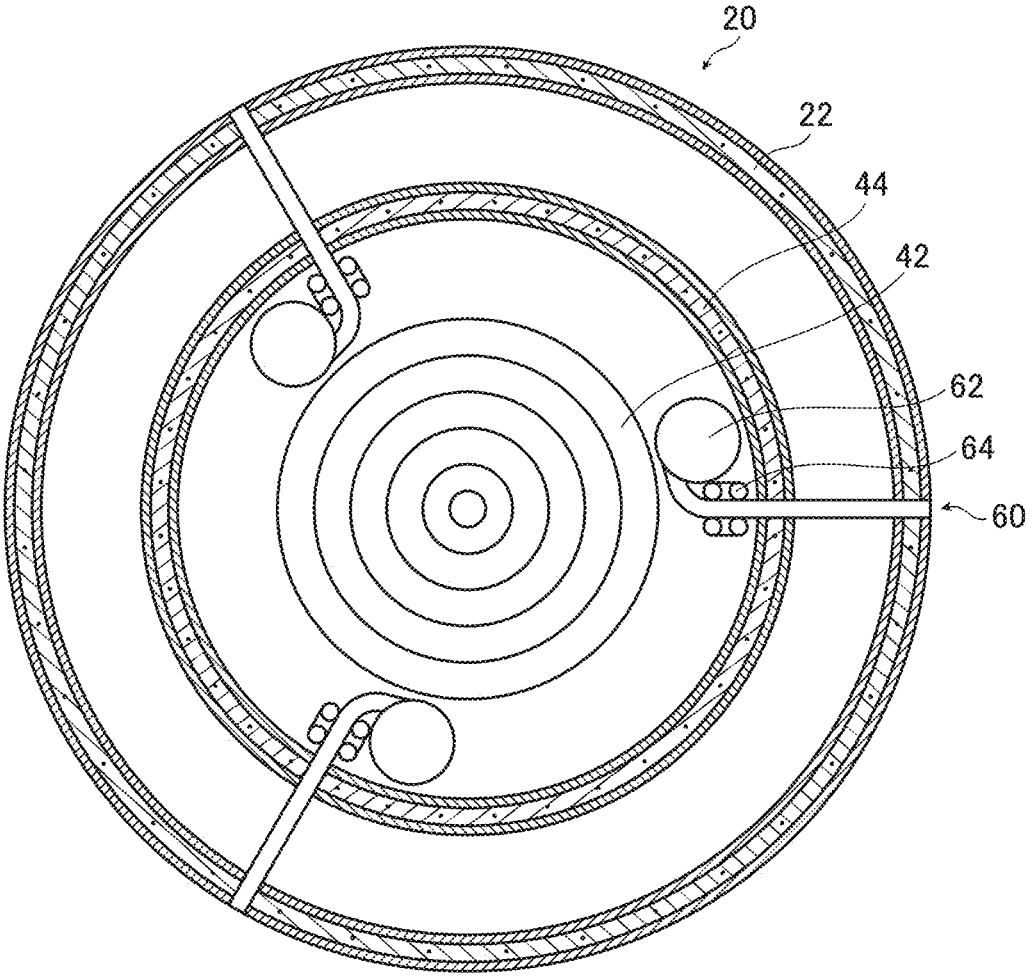
FIG. 5 is a cross sectional view in a line BB of the resource collection device shown in FIG. 2.
Figure 6:
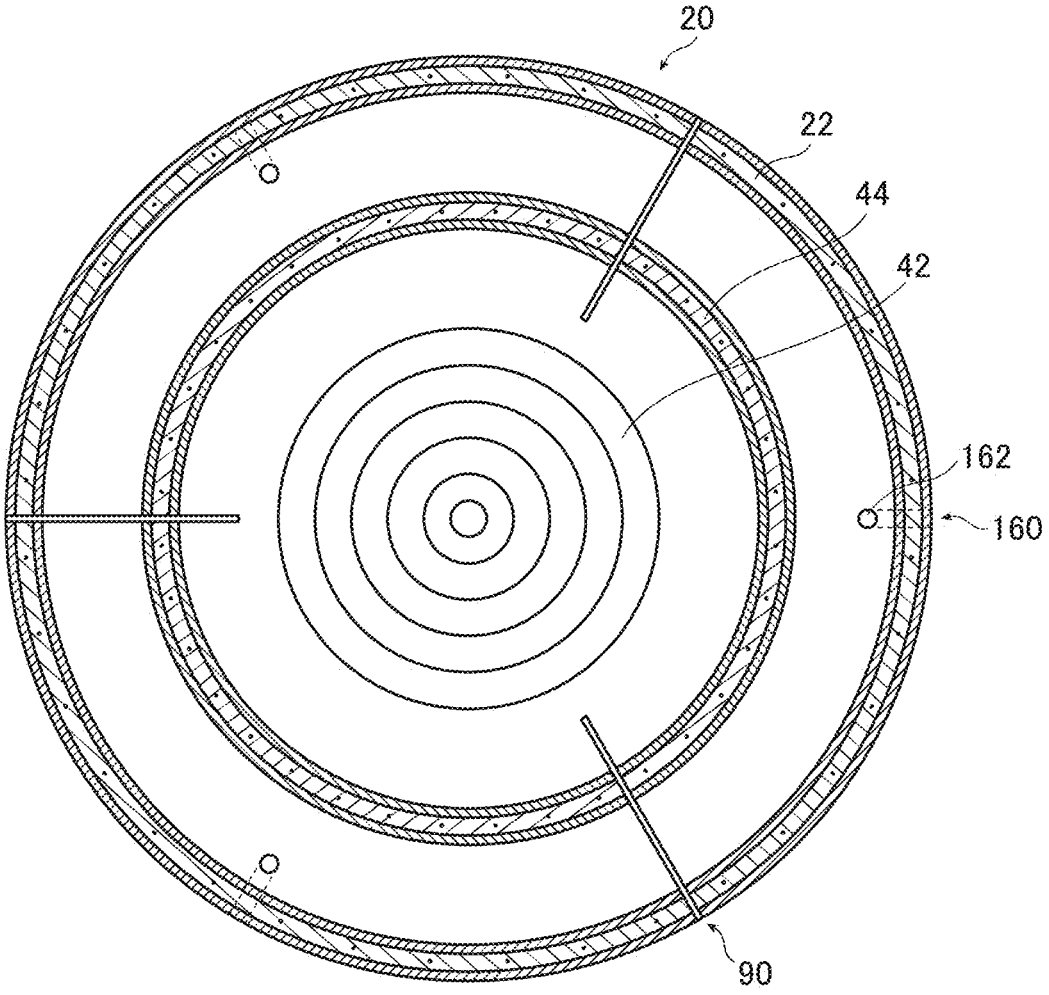
FIG. 6 is a cross sectional view in a line CC of the resource collection device shown in FIG. 2.
Figure 7:
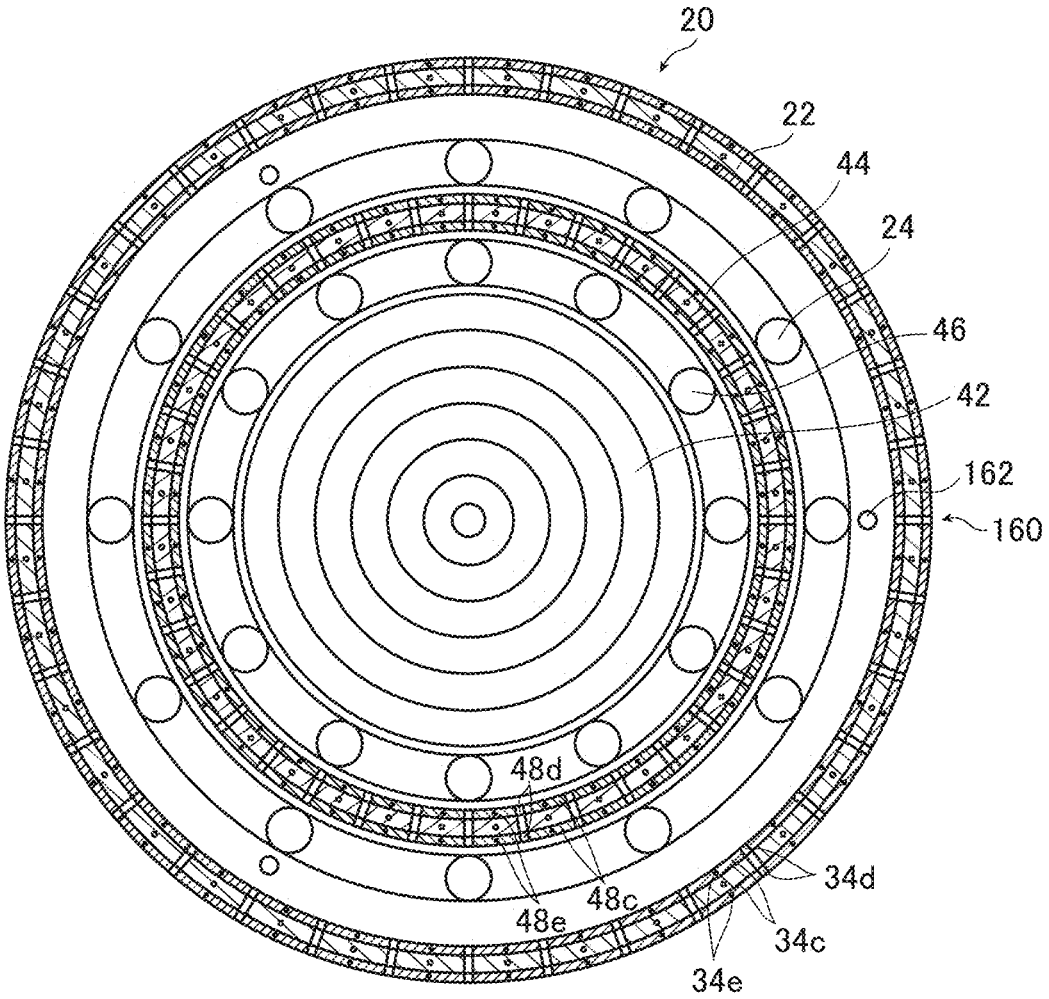
FIG. 7 is a cross sectional view in a line DD of the resource collection device shown in FIG. 2.
Figure 8:
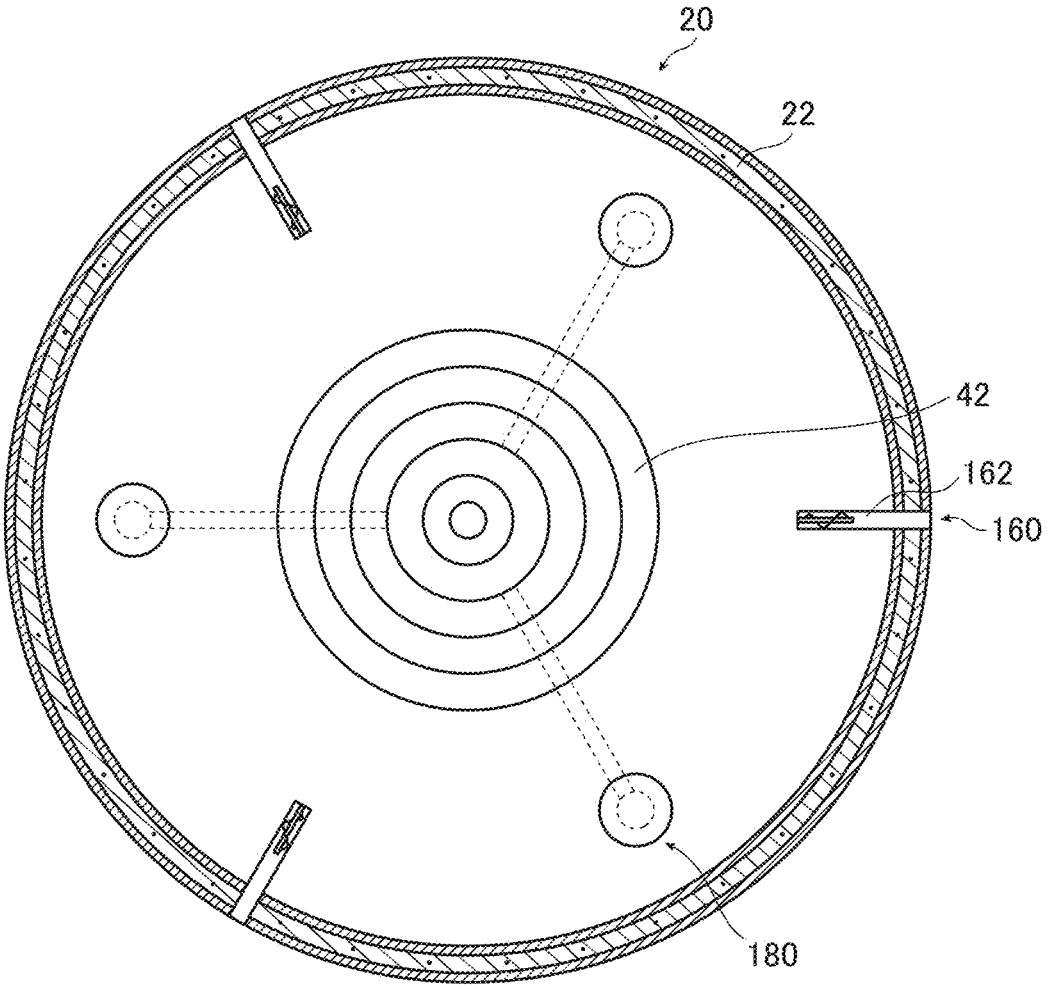
FIG. 8 is a cross sectional view in a line EE of the resource collection device shown in FIG. 2.

Subsequently, the resource collection system in the first embodiment of the present invention is explained with reference to the resource collection device configuring the resource collection system. FIG. 2 is a longitudinal sectional view schematically showing a function of the resource collection device configuring the resource collection system shown in FIG. 1. FIG. 3 is a partial longitudinal sectional view schematically showing a function of a filter configuring the resource collection device shown in FIG. 2 and the periphery of the filter. FIGS. 4 to 8 are cross sectional views in lines AA to EE of the resource collection device shown in FIG. 2.

<Resource Collection>

A resource collection device 20 configuring the resource collection system of the present invention includes a resource collection pipe, a protective pipe 22, and a filter 24. The resource collection pipe sends resources collected from the seabed layer 18 to the collected resource storage tank 12*a*. The protective pipe 22 is provided around the resource collection pipe and protects the resource collection pipe. The filter 24 is disposed on the inside of the protective pipe 22 and removes sediment excavated from the seabed layer 18. The protective pipe 22 is disposed with an axial direction directed vertically with respect to the sea surface. The resource collection pipe includes a gas collection pipe 26 and an oil collection pipe 28. The gas collection pipe 26 is connected to a gas storage chamber 30 provided above the filter 24. The oil storage chamber 28 is connected to an oil storage chamber 32 provided below the filter 24. The filter 24 includes a resource collection hole 24*b* piercing through the filter 24 in a longitudinal direction. Among resources having passed through the filter 24 from the outer side toward the inner side and reached the resource collection hole 24*b*, the resource collection system of the present invention raises gas to the gas storage chamber 30 and drops oil to the oil storage chamber 32.

By adopting such a configuration, the resource collection system of the present invention can simultaneously collect the gas and the oil. Therefore, the resource collection system can more efficiently collect resources from the seabed layer.

The crushed seabed layer 18 moves to the filter 24 through, for example, at least one sidewall hole 22*b* that pierces through a sidewall 22*a* of the protective pipe 22 provided around the resource collection pipe. The gas collection pipe 26 includes a gas collection pipe 26*a* that collects gas having relatively large specific weight such as butane and a gas collection pipe 26*b* that collects gas having relatively small specific weight such as methane. The oil collection pipe 28 includes an oil collection pipe 28*a* that collects oil having relatively large specific weight and an oil collection pipe 28*b* that collects oil having relatively small specific weight. The shapes, the sizes, and the numbers of filters 24 and resource collection holes 24*b* are not particularly limited. However, it is preferable that the shapes, the sizes, and the numbers are optimized such that resources can be most efficiently collected.

<Filter Disposition>

A resource collection device 20 configuring the resource collection system of the present invention includes the resource collection pipe, the protective pipe 22, and the filter 24. The resource collection pipe sends resources collected from the seabed layer 18 to the collected resource storage tank 12*a*. The protective pipe 22 is provided around the resource collection pipe and protects the resource collection pipe. The filter 24 is disposed on the inside of the protective pipe 22 and removes sediment excavated from the seabed layer 18. The filter 24 includes a plurality of columnar elements 24*a*. The elements 24*a* are disposed in at least one position with respect to the longitudinal direction at a predetermined interval in a circumferential direction of the positions. The resource collection pipe of the present invention includes the gas collection pipe 26 and the oil collection pipe 28.

By adopting such a configuration, the resource collection system of the present invention less easily simultaneously breaks down. Therefore, the resource collection system can stably operate continuously for a long time.

The size and the number of filters 24 are not particularly limited. However, it is preferable that the size and the number are optimized such that resources can be most efficiently collected. The number of stages in the longitudinal direction of the filter 24 is not particularly limited. The material of the elements 24*a* is not particularly limited. However, it is preferable that the material is ceramic.

<Filter Freezing Prevention>

A resource collection device 20 configuring the resource collection system of the present invention includes a resource collection pipe, the protective pipe 22, and the filter 24. The resource collection pipe sends resources collected from the seabed layer 18 to the collected resource storage tank 12*a*. The protective pipe 22 is provided around the resource collection pipe and protects the resource collection pipe. The filter 24 is disposed on the inside of the protective pipe 22 and removes sediment excavated from the seabed layer 18. The resource collection system of the present invention prevents freezing of the seawater on the surface and the inside of the filter 24 by feeding high-pressure hot water or high-pressure steam into a through-hole 24*c* in the longitudinal direction of the filter 24. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

During resource collection, high-pressure hot water or high-pressure steam for freezing prevention is fed from an upper pipe 38*d* to a lower pipe 40*d* through the through-hole 24*c* or in the opposite direction. The high-pressure hot water or the high-pressure steam is supplied from the water supply device 12*b* via a heater and a high-pressure pump and may be supercritical water. The shape, the size, and the number of filters 24 are not particularly limited. However, it is preferable that the shape, the size, and the number are optimized such that resources can be most efficiently collected. The shape, the size, and the number of through-holes 24*c* are not particularly limited. However, it is preferable that the shape, the size, and the number are optimized such that heating can be most efficiently performed. Freezing of the seawater on the surface and the inside of the filter 24 may be prevented by applying the high-pressure hot water or the high-pressure steam to the surface of the filter 24 instead of feeding the high-pressure hot water or the high-pressure steam into the through-hole 24*c* in the longitudinal direction of the filter 24. Freezing of the seawater on the surface and the inside of the filter 24 may be prevented by transferring heat of the high-pressure hot water or the high-pressure steam to the filter 24 through heat transfer means at both ends in the longitudinal direction of the filter 24 instead of feeding the high-pressure hot water or the high-pressure steam into the through-hole 24*c* in the longitudinal direction of the filter 24.

The heat transfer means of the present invention includes a filter fixing plate 58*a*, a center guide plate 58*b*, an outer guide plate 58*c*, and an inner guide plate 58*d*. The filter fixing plate 58*a* is a plate that fixes both ends in the longitudinal direction of the filter 24 from both sides. The center guide plate 58*b* is a plate that guides small pieces of the seabed layer 18 having passed through the sidewall hole 22*b* to the filter 24 and is thermally in contact with the filter fixing plate 58*a*. The outer guide plate 58*c* is a plate on the outer side of the center guide plate 58*b* that guides the small pieces in the same manner and is thermally in contact with the protective pipe 22 and the center guide plate 58*b*. The inner guide plate 58*d* is a plate on the inner side of the center guide plate 58*b* that guides the small pieces in the same manner and is thermally in contact with the center guide plate 58*b*. The heat transfer means at one end and the heat transfer means at the other end in the longitudinal direction of the filter 24 may be directly heated by applying the high-pressure hot water or the high-pressure steam or may be indirectly heated by heat conduction from the protective pipe 22 heated by the high-pressure hot water or the high-pressure steam.

<Protective Pipe with Sidewall Holes>

A resource collection device 20 configuring the resource collection system of the present invention includes the resource collection pipe, the protective pipe 22, the filter 24, and a gate pipe 34. The resource collection pipe sends resources collected from the seabed layer 18 to the collected resource storage tank 12*a*. The protective pipe 22 includes the sidewall 22*a* provided around the resource collection pipe and a plurality of sidewall holes 22*b* piercing through the sidewall 22*a* and protects the resource collection pipe. The filter 24 is disposed on the inside of the protective pipe 22 and removes sediment excavated from the seabed layer 18. The gate pipe 34 is disposed at least one of on the outer side of the protective pipe 22 and between the protective pipe 22 and the filter 24 in order to open and close the plurality of sidewall holes 22*b*. The resource collection system of the present invention opens the plurality of sidewall holes 22*b* when collecting resources from the seabed layer 18 and closes the plurality of sidewall holes 22*b* at times other than when collecting the resources. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

A part of the gate pipe 34 disposed on the outer side of the protective pipe 22 is an outer gate pipe 34*a* and a part of the gate pipe 34 disposed between the protective pipe 22 and the filter 24 is an inner gate pipe 34*b*. Each of the outer gate pipe 34*a* and the inner gate pipe 34*b* includes a sidewall 34*c*, a plurality of sidewall holes 34*d* piercing through the sidewall 34*c*, and a through-hole 34*e* in the axial direction of the sidewall 34*c*. When the size of the sidewall holes 34*d* is substantially the same as the size of the sidewall holes 22*b* of the protective pipe 22 and the length of the sidewall hole 34*d* in the circumferential direction of the gate pipe 34 is smaller than a half of a pitch in the circumferential direction, the sidewall holes 22*b* of the protective pipe 22 can be closed by rotating the gate pipe 34 by the length of the sidewall holes 34*d* using a hydraulic motor or an air motor. Similarly, when the length of the sidewall holes 34*d* in the axial direction of the gate pipe 34 is smaller than a half of a pitch in the axial direction, the sidewall holes 22*b* of the protective pipe 22 can be closed by moving the gate pipe 34 in the axial direction by the length of the sidewall holes 34*d* using a hydraulic motor or an air motor. The shapes, the sizes, and the numbers of sidewall holes 22*b* and sidewall holes 34*d* are not particularly limited. However, it is preferable that the shapes, the sizes, and the numbers are optimized such that resources can be most efficiently collected. The materials of the protective pipe 22 and the gate pipe 34 are not particularly limited. However, it is preferable that the materials are iron or stainless steel.

<Opening Conditions>

The resource collection system of the present invention may open the plurality of sidewall hole 22*b* after raising the pressure on the inner side of the protective pipe 22 to the same pressure as the pressure of the seabed layer 18 on the outer side of the protective pipe 22.

By adopting such a configuration, the resource collection system of the present invention less easily breaks down. Therefore, the resource collection system can stably operate continuously for a long time.

<Protective Pipe Freezing Prevention>

The resource collection system of the present invention may prevent freezing of the seawater between the protective pipe 22 and the gate pipe 34 and in the plurality of sidewall holes 22*b* by feeding high-pressure hot water or high-pressure steam into a through-hole 22*c* or a spiral through-hole in the axial direction of the sidewall 22*a* of the protective pipe 22.

By adopting such a configuration, the resource collection system of the present invention less easily breaks down. Therefore, the resource collection system can stably operate continuously for a long time.

During resource collection, high-pressure hot water or high-pressure steam for freezing prevention is fed from an upper pipe 38*a* to a lower pipe 40*a* through the through-hole 22*c* or in the opposite direction. The high-pressure hot water or the high-pressure steam is supplied from the water supply device 12*b* via a heater and a high-pressure pump and may be supercritical water. The spiral through-hole can be configured by a method of filling up a plurality of thin tubes with wax, closing both ends of the thin tubes, loading explosive around the thin tubes, and igniting the explosive, and welding the thin tubes to one another with a shock of the explosion. The shape, the size, and the number of through-holes 22*c* are not particularly limited. However, it is preferable that the shape, the size, and the number are optimized such that heating can be most efficiently performed.

<Gate Pipe Freezing Prevention>

The resource collection system of the present invention may prevent freezing of the seawater between the protective pipe 22 and the gate pipe 34 and in the plurality of sidewall holes 34*d* by feeding high-pressure hot water or high-pressure steam into the through-hole 34*e* or a spiral through-hole in the axial direction of the sidewall 34*c* of the gate pipe 34.

By adopting such a configuration, the resource collection system of the present invention less easily breaks down. Therefore, the resource collection system can stably operate continuously for a long time.

During resource collection, high-pressure hot water or high-pressure steam for freezing prevention is fed from the upper pipe 38*a* to the lower pipe 40*a* through the through-hole 34*e* or in the opposite direction. The high-pressure hot water or the high-pressure steam is supplied from the water supply device 12*b* via a heater and a high-pressure pump and may be supercritical water. The shape, the size, and the number of through-holes 34*e* are not particularly limited. However, it is preferable that the shape, the size, and the number of through-holes 34*e* are optimized such that heating can be most efficiently performed.

<Pre-Coating>

The resource collection system of the present invention may coat the filter 24 by, in a state in which a coating agent is mixed in high-pressure water and the plurality of sidewall holes 22*b* are closed, feeding the high-pressure water mixed with the coating agent in the same direction as a direction in which resources flow in the filter 24 when the resources are collected.

By adopting such a configuration, the resource collection system of the present invention less easily breaks down. Therefore, the resource collection system can stably operate continuously for a long time.

During pre-coating before resource collection, the high-pressure water mixed with the coating agent is fed from an upper pipe 38*b* to a lower pipe 40*d* or from a lower pipe 40*b* to an upper pipe 38*d*. The high-pressure water is supplied from the water supply device 12*b* via a high-pressure pump. The coating agent is supplied from a storage tank 36. The material of the coating agent is diatomaceous earth or diatomaceous earth with magnetic body powder.

<Reverse Cleaning>

The resource collection system of the present invention may clean the inside of the filter 24 by, in a state in which the plurality of sidewall holes 22*b* are closed, feeding the high-pressure water in the opposite direction of the direction in which resources flow in the filter 24 when the resources are collected.

By adopting such a configuration, the resource collection system of the present invention less easily breaks down. Therefore, the resource collection system can stably operate continuously for a long time.

During the reverse cleaning after the resource collection, the high-pressure water is fed from the upper pipe 38*d* to the lower pipe 40*b* or from the lower pipe 40*d* to the upper pipe 38*b*. The high-pressure water is supplied from the water supply device 12*b* via a high-pressure pump.

<Showering>

The resource collection system of the present invention may further clean the surface of the filter 24 by, in a state in which the plurality of sidewall holes 22*b* are closed, high-pressure hot water or high-pressure steam to the surface of the filter 24.

By adopting such a configuration, the resource collection system of the present invention less easily breaks down. Therefore, the resource collection system can stably operate continuously for a long time.

During the reverse cleaning after the resource collection, further, high-pressure hot water or high-pressure steam for showering is fed from an upper pipe 38*c* to the lower pipe 40*b* or from a lower pipe 40*c* to the upper pipe 38*b*. The high-pressure hot water or the high-pressure steam is supplied from the water supply device 12*b* via a heater and a high-pressure pump and may be supercritical water. Here, the supercritical water means water in a state in which temperature and pressure respectively exceed the critical temperature of 374° C. and the critical pressure of 22.1 Mpa.

The resource collection device 20 further includes a center pipe 42 disposed in the center. The center pipe 42 includes a cooling water supply pipe 42*a* for cooling of the drilling device 16, a cooling water recovery pipe 42*b*, an air supply pipe 42*c* for supplying air to the inside of the resource collection device 20, an exhaust gas recovery pipe 42*d* for collecting exhaust gas from the inside of the resource collection device 20, a piping housing pipe 42*e* for housing pipes for gas, liquid, and solid necessary for the resource collection device 20, and a wiring housing pipe 42*f* for housing electric wires necessary for the resource collection device 20. The center pipe 42 is not limited to a sextet pipe configuration and may have a configuration in which five independent pipes are housed on the inside of one pipe. The storage tank 36 of the resource collection device 20 may further include regions for respectively temporarily storing water, fuel gas, liquid concentrates of a foaming material, conductive particles, crushed particles, and cement particles.

<Secondary Protective Pipe>

The resource collection device 20 configuring the resource collection system of the present invention may further include a secondary protective pipe 44, a secondary filter 46, and a secondary gate pipe 48. The secondary protective pipe 44 includes a secondary sidewall 44*a* disposed on the inner side of the filter 24 and a plurality of secondary sidewall holes 44*b* piercing through the secondary sidewall 44*a*. The secondary filter 46 is disposed on the inside of the secondary protective pipe 44 and removes sediment excavated from the seabed layer 18. The secondary gate pipe 48 is disposed at least one of between the filter 24 and the secondary protective pipe 44 and between the secondary protective pipe 44 and the secondary filter 46 in order to open and close the plurality of secondary sidewall holes 44*b*.

By adopting such a configuration, the resource collection system of the present invention less easily simultaneously breaks down. Therefore, the resource collection system can stably operate continuously for a long time.

The resource collection system of the present invention opens the plurality of secondary sidewall holes 44*b* when collecting resources from the seabed layer 18 and closes the plurality of secondary sidewall holes 44*b* at times other than when collecting the resources. A part of the secondary gate pipe 48 disposed between the filter 24 and the secondary protective pipe 44 is a secondary outer gate pipe 48*a*. A part of the secondary gate pipe 48 disposed between the secondary protective pipe 44 and the secondary filter 46 is a secondary inner gate pipe 48*b*. Each of the secondary outer gate pipe 48*a* and the secondary inner gate pipe 48*b* includes a secondary sidewall 48*c*, a plurality of secondary sidewall holes 48*d* piercing through the secondary sidewall 48*c*, and a secondary through-hole 48*e* in the axial direction of the secondary sidewall 48*c*. When the size of the secondary sidewall holes 48*d* is substantially the same as the size of the secondary sidewall holes 44*b* of the secondary protective pipe 44 and the length of the secondary sidewall holes 48*d* in the circumferential direction of the secondary gate pipe 48 is smaller than a half of a pitch in the circumferential direction, the secondary sidewall holes 44*b* of the secondary protective pipe 44 can be closed by rotating the secondary gate pipe 48 by the length of the secondary sidewall holes 48*d* using a hydraulic motor or an air motor. Similarly, when the length of the secondary sidewall holes 48*d* in the axial direction of the secondary gate pipe 48 is smaller than a half of a pitch in the axial direction, the secondary sidewall holes 44*b* of the secondary protective pipe 44 can be closed by moving the secondary gate pipe 48 in the axial direction by the length of the secondary sidewall holes 48*d* using a hydraulic motor or an air motor. The shapes, the sizes, and the numbers of secondary sidewall holes 44*b* and secondary sidewall holes 48*d* are not particularly limited. However, it is preferable that the shapes, the sizes, and the numbers are optimized such that resources are most efficiently collected. The materials of the secondary protective pipe 44 and the secondary gate pipe 48 are not particularly limited. However, it is preferable that the materials are iron or stainless steel.

The resource collection system of the present invention may prevent freezing of the seawater between the secondary protective pipe 44 and the secondary gate pipe 48 and in the plurality of secondary sidewall holes 44*b* by feeding high-pressure hot water or high-pressure steam into a secondary through-hole 44*c* or a spiral through-hole in the axial direction of the secondary sidewall 44*a* of the secondary protective pipe 44. During resource collection, high-pressure hot water or high-pressure steam for freezing prevention is fed from the upper pipe 38*a* to the lower pipe 40*a* through the secondary through-hole 44*c* or in the opposite direction. The high-pressure hot water or the high-pressure steam is supplied from the water supply device 12*b* via a heater and a high-pressure pump and may be supercritical water. The shape, the size, and the number of secondary through-hole 44*c* are not particularly limited. However, it is preferable that the shape, the size, and the number are optimized such that heating can be most efficiently performed.

The resource collection system of the present invention may prevent freezing of the seawater between the secondary protective pipe 44 and the secondary gate pipe 48 and in the plurality of secondary sidewall holes 48*d* by feeding high-pressure hot water or high-pressure steam into the secondary through-hole 48*e* or the spiral through-hole in the axial direction of the secondary sidewall 48*c* of the secondary gate tube 48. During resource collection, high-pressure hot water or high-pressure steam for freezing prevention is fed from the upper pipe 38*a* to the lower pipe 40*a* through the secondary through-hole 48*e* or in the opposite direction. The high-pressure hot water or the high-pressure steam is supplied from the water supply device 12*b* via a heater and a high-pressure pump and may be supercritical water. The shape, the size, and the number of secondary through-holes 48*e* are not particularly limited. However, it is preferable that the shape, the size, and the number are optimized such that heating can be most efficiently performed.

The secondary protective pipe 44 is disposed with the axial direction directed vertically with respect to the sea surface. The resource collection pipe includes a secondary gas collection pipe 50 and a secondary oil collection pipe 52. The secondary gas collection pipe 50 is connected to a secondary gas storage chamber 54 provided above the secondary filter 46. The secondary oil collection pipe 52 is connected to a secondary oil storage chamber 56 provided below the secondary filter 46. The secondary filter 46 includes a secondary resource collection hole 46*b* piercing through the secondary filter 46 in the longitudinal direction. Among resources having passed through the secondary filter 46 from the outer side toward the inner side and reached the secondary resource collection hole 46*b*, the resource collection system of the present invention raises gas to the secondary gas storage chamber 54 and drops oil to the secondary oil storage chamber 56.

The secondary gas collection pipe 50 includes a secondary gas collection pipe 50*a* for collecting gas having relatively large specific weight such as methane and a secondary gas collection pipe 50*b* for collecting gas having relatively small specific weight such as butane. The secondary oil collection pipe 52 includes a secondary oil collection pipe 52*a* for collecting oil having relatively large specific weight and a secondary oil collection pipe 52*b* for collecting oil having relatively small specific weight. The shapes, the sizes, and the numbers of secondary filters 46 and secondary resource collection holes 46*b* are not particularly limited. However, it is preferable that the shapes, the sizes, and the numbers are optimized such that resources can be most efficiently collected.

The secondary filter 46 includes a plurality of columnar secondary elements 46*a*. The secondary elements 46*a* are disposed in at least one position with respect to the longitudinal direction at a predetermined interval in the circumferential direction of the positions. The size and the number of secondary filters 46 are not particularly limited. However, it is preferable that the size and the number are optimized such that resources can be most efficiently collected. The number of stages in the longitudinal direction of the secondary filter 46 is not particularly limited. The material of the secondary elements 46*a* is not particularly limited. However, it is preferable that the material is ceramic.

The resource collection system of the present invention prevents freezing of the seawater on the surface and the inside of the secondary filter 46 by feeding high-pressure hot water or high-pressure steam into a secondary through-hole 46*c* in the longitudinal direction of the secondary filter 46. During resource collection, high-pressure hot water or high-pressure steam for freezing prevention is fed from the upper pipe 38*d* to the lower pipe 40*d* through the secondary through-hole 46*c* or in the opposite direction. The high-pressure hot water or the high-pressure steam is supplied from the water supply device 12*b* via a heater and a high-pressure pump and may be supercritical water. The shape, the size, and the number of secondary through-holes 46*c* are not particularly limited. However, it is preferable that the shape, the size, and the number are optimized such that heating can be most efficiently performed.

Figure 9:
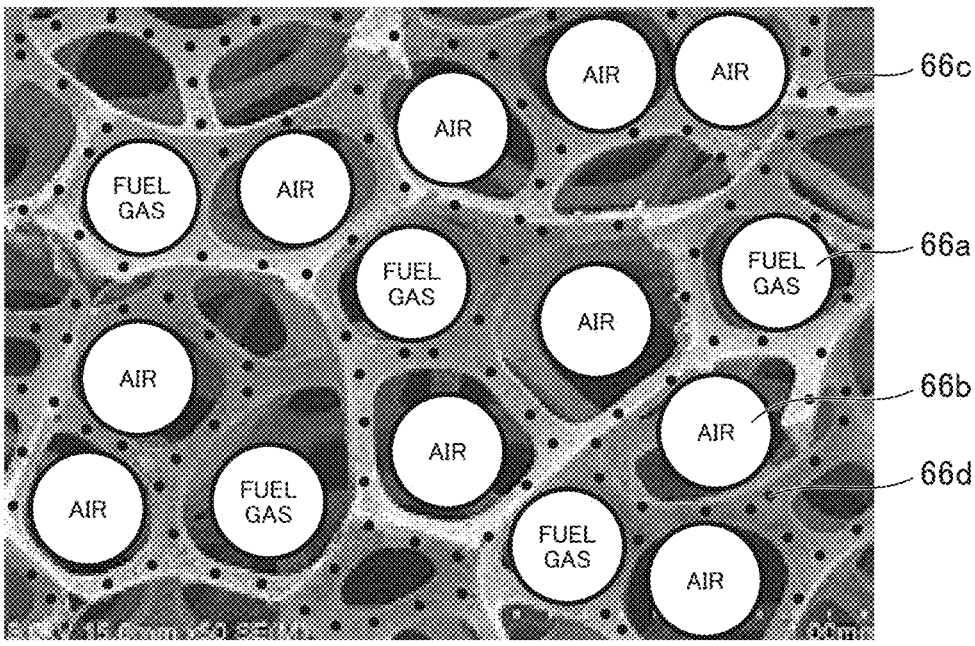
FIG. 9 is an image diagram of a foaming material, fuel gas, and air supplied into a seabed layer.
Figure 10:
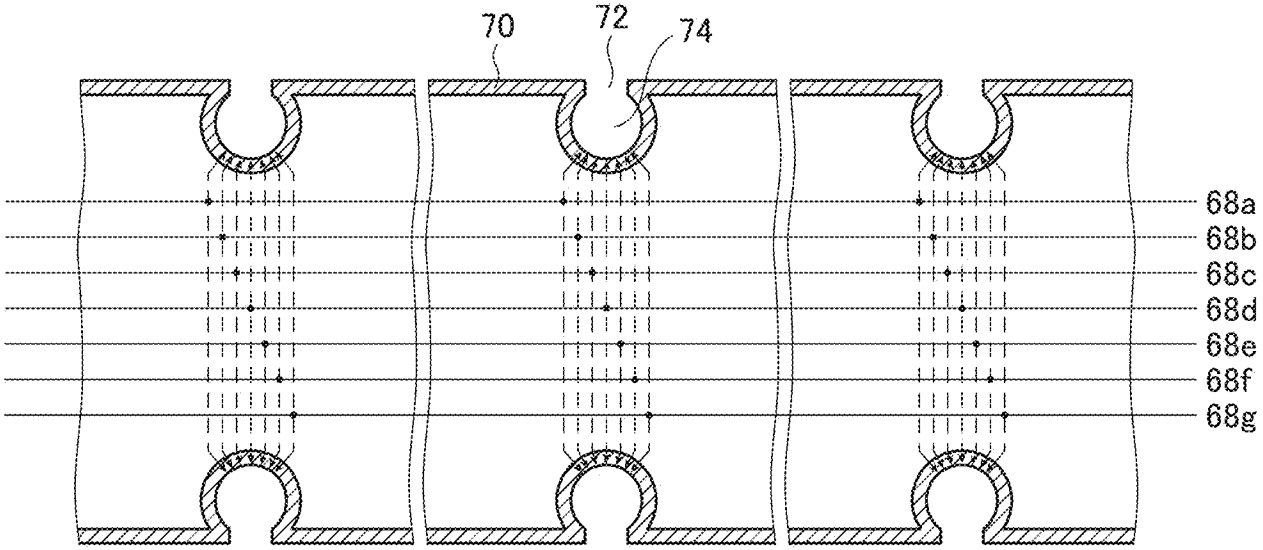
FIG. 10 is a partial longitudinal sectional view schematically showing a function of an example of a coiled tubing device configuring the resource collection device shown in FIG. 2.

Subsequently, an example of a coiled tubing device configuring the resource collection device and a foaming material are explained. FIG. 9 is an image diagram of a foaming material, fuel gas, and air supplied into a seabed layer. FIG. 10 is a partial longitudinal sectional view schematically showing a function of an example of a coiled tubing device configuring the resource collection device shown in FIG. 2.

<Coiled Tubing Device, Foaming Material, and Fuel Gas>

A resource collection device 20 configuring the resource collection system of the present invention includes the resource collection pipe, the protective pipe 22, and a coiled tubing device 60. The resource collection pipe sends resources collected from the seabed layer 18 to the collected resource storage tank 12*a*. The protective pipe 22 is provided around the resource collection pipe and protects the resource collection pipe. The coiled tubing device 60 is let out, by a letting-out device 64, from a winding reel 62 disposed on the sea surface or the inside of the protective pipe 22 and extends from the inner side to the outer side piercing through the sidewall 22*a* of the protective pipe 22.

The resource collection system of the present invention crushes the seabed layer 18 by supplying liquid concentrates of a foaming material, fuel gas generation, and air including oxygen into the seabed layer 18 through the coiled tubing device 60, mixing the liquid concentrates of the foaming material with one another to cause the liquid concentrates to foam in an atmosphere including fuel gas 66*a* and air 66*b*, and explosively burning the fuel gas 66*a* accumulated in a cavity of a foaming material 66*c*. The resource collection pipe of the present invention includes the gas collection pipe 26 and the oil collection pipe 28.

By adopting such a configuration, the resource collection system of the present invention can heat the seabed layer in a wide range in a short time. Therefore, the resource collection system can more efficiently collect resources from the seabed layer.

By explosively burning the fuel gas 66*a* accumulated in the cavity of the foaming material 66*c*, it is possible to form, in the seabed layer 18, the cracks 18*a* for more efficiently collecting resources from the seabed layer 18. The coiled tubing device 60 is an example of the coiled tubing device and includes a small drilling device at the distal end thereof. The coiled tubing device 60 may include, on the inside, a resource collection pipe for collecting resources jetted from the cracks 18*a*. The number of coiled tubing devices 60 is not particularly limited if the coiled tubing devices 60 can be housed on the inside of the resource collection device 20. The liquid concentrates of the foaming material may be stored by setting, on the inside of the storage tank 36, a region for temporarily storing the liquid concentrates. The foaming material is not particularly limited. However, when foamed urethane is used, it is preferable that the foaming material is a foaming material including two liquids of polyisocyanate and polyol as liquid concentrates. When foamed silicone is used, it is preferable that the foaming material is a foaming material including two liquids of two-component type liquid silicon as liquid concentrates and formed by, after mixing, agitating the two liquids and foaming the two liquids. Further, other foamed polymer may be used. The material of the fuel gas 66*a* is not particularly limited. However, it is preferable that the material is gas such as methane, ethane, propane, or butane. As the fuel gas 66*a*, gas collected from the seabed layer 18 may be used. Note that the fuel gas 66*a* and the air 66*b* shown in FIG. 9 are schematically shown as different spherical bodies. However, since the fuel gas 66*a* and the air 66*b* are supplied into the cavity of the foaming material 66*c* as mixed gas, the fuel gas 66*a* and the air 66*b* are not separated. A method of injecting fluid having high temperature such as water vapor or hot water into a methane-hydrate layer and decomposing methane hydrate is called "heating method" or "thermal stimulation method".

The seabed layer 18 may be crushed by supplying, instead of supplying the fuel gas 66*a*, for example, carbide (calcium carbide) particle and high-pressure water as materials for generating fuel gas, generating acetylene gas of the fuel gas with chemical reaction of the carbide particles and the high-pressure water, and explosively burning the acetylene gas accumulated in the cavity of the foaming material 66*c*. Hydrogen of the fuel gas may be generated by reaction of potassium, calcium, or sodium and cold water, reaction of magnesium and hot water, reaction of aluminum, zinc, or iron and high-temperature water vapor, or the like. The seabed layer 18 may be crushed by supplying, instead of supplying the fuel gas 66*a*, for example, methanol and high-pressure water as materials for generating fuel gas, generating methane gas of the fuel gas with decomposition promotion of the seabed layer, that is, a methane-hydrate layer by the methanol, and explosively burning the methane gas accumulated in the cavity of the foaming material 66*c*. A method of mixing an inhibitor such as methanol or salt, which promotes decomposition of methane hydrate, with water and injecting the inhibitor into a methane-hydrate layer is called "inhibitor method" or "inhibitor injection method".

<Mixing Chamber>

The coiled tubing device 60 may include a tubular tube outer wall 70, an opening 72, and a mixing chamber 74. The opening 72 is provided in the tube outer wall 70. The mixing chamber 74 is provided on the inner side of the opening 72. The resource collection system of the present invention mixes the liquid concentrates of the foaming material with one another in the mixing chamber 74 and thereafter supplies a mixture of the liquid concentrates to between the seabed layer 18 and the tube outer wall 70 through the opening 72 together with the fuel gas 66*a* and the air 66*b*.

By adopting such a configuration, the resource collection system of the present invention can heat the seabed layer in a wide range in a short time. Therefore, the resource collection system can more efficiently collect resources from the seabed layer.

The tube outer wall 70 of the coiled tubing device 60 is a welded steel pipe and is manufactured by welding a seam formed in the longitudinal direction of a pipe while rounding a belt-like steel plate in a tubular shape with continuous rolling. When length is insufficient, the steel plate is joined by bias welding for obliquely cutting and welding the end side of the steel plate. The fuel gas 66*a* is supplied from the fuel-gas supply device 12*c* to the mixing chamber 74 through a fuel gas supply pipe 68*a*. The air 66*b* is supplied from the air supply device 12*d* to the mixing chamber 74 through the air supply pipe 42*c* and an air supply pipe 68*b*. The liquid concentrates of the foaming material are supplied from the foaming-material-liquid-concentrate supply device 12*e* to the mixing chamber 74 through a foaming material liquid concentrate supply pipe 68*c*. When carbide (calcium carbide) particles and high-pressure water are supplied instead of supplying the fuel gas 66*a*, the carbide particles are supplied from the fuel-gas supply device 12*c* to the mixing chamber 74 through a fuel gas supply pipe 68*a* and the high-pressure water is supplied from the water supply device 12*b* to the mixing chamber 74 through a high-pressure water supply pipe 68*e* and a high-pressure pump. When methanol and high-pressure water are supplied instead of supplying the fuel gas 66*a*, the methanol is supplied from the fuel-gas supply device 12*c* to the mixing chamber 74 through the fuel gas supply pipe 68*a*, and the high-pressure water is supplied from the water supply device 12*b* to the mixing chamber 74 through the high-pressure water supply pipe 68*e* and a high-pressure pump. The shape of the opening 72 is not particularly limited if the liquid concentrates of the foaming material after the mixing can pass through the opening 72. The size and the number of openings 72 are not particularly limited if the strength of the tube outer wall 70 is not insufficient. The shape of the mixing chamber 74 is not particularly limited if the liquid concentrates of the foaming material can be mixed with one another in the mixing chamber 74. The size and the number of mixing chambers 74 are not particularly limited if the strength of the coiled tubing device 60 is not insufficient.

<Ignition Wire>

The foaming material 66*c* formed by mixing the liquid concentrates of the foaming material with one another may include conductive particles 66*d* such as conductor metal or carbon nanotube. The resource collection system of the present invention may ignite the fuel gas 66*a* accumulated in the cavity of the foaming material 66*c* or fuel gas generated instead of the fuel gas 66*a* by applying a high voltage between the foaming material 66*c* having conductivity and an ignition wire 68*g* exposed to the tube outer wall 70 or the mixing chamber 74 and electrically insulated.

By adopting such a configuration, the resource collection system of the present invention can heat the seabed layer in a wide range in a short time. Therefore, the resource collection system can more efficiently collect resources from the seabed layer.

The conductive particles 66*d* are supplied from the conductive-particle supply device 12*f* to the mixing chamber 74 through a conductive particle supply pipe 68*d*. The conductive particles 66*d* may be stored by setting, on the inside of the storage tank 36, a region for temporarily storing the conductive particles 66*d*.

<Ignition Plug>

The resource collection system of the present invention may ignite the fuel gas 66*a* accumulated in the cavity of the foaming material 66*c* or fuel gas generated instead of the fuel gas 66*a* by applying a high voltage to an ignition plug (not illustrated) provided in the tube outer wall 70 or the mixing chamber 74.

By adopting such a configuration, the resource collection system of the present invention can heat the seabed layer in a wide range in a short time. Therefore, the resource collection system can more efficiently collect resources from the seabed layer.

<Mixing Chamber Cleaning>

The resource collection system of the present invention may clean the mixing chamber 74 using at least one of high-pressure water and high-pressure air.

By adopting such a configuration, the resource collection system of the present invention can heat the seabed layer in a wide range in a short time. Therefore, the resource collection system can more efficiently collect resources from the seabed layer.

The high-pressure water is supplied from the water supply device 12*b* to the mixing chamber 74 through the high-pressure water supply pipe 68*e* and a high-pressure pump. The high-pressure air is supplied from the air supply device 12*d* to the mixing chamber 74 through a high-pressure air supply pipe 68*f* and a high-pressure pump.

Subsequently, a modification of the coiled tubing device configuring the resource collection device is explained.

<Protective Pipe With Sidewall Holes of the Coiled Tubing Device>

A resource collection device 20 configuring the resource collection system of the present invention includes the resource collection pipe, the protective pipe 22, and the coiled tubing device. The resource collection pipe sends resources collected from the seabed layer 18 to the collected resource storage tank 12*a*. The protective pipe 22 is provided around the resource collection pipe and protects the resource collection pipe. The coiled tubing device is let out, by a letting-out device 64, from the winding reel 62 disposed on the sea surface or the inside of the protective pipe 22 and extends from the inner side to the outer side piercing through the sidewall 22*a* of the protective pipe 22. The coiled tubing device includes a sub resource collection pipe, a sub protective pipe, a sub filter, and a sub gate pipe. The sub resource collection pipe sends resources collected from the seabed layer 18 to the collected resource pipe. The sub protective pipe includes a sub sidewall provided around the sub resource collection pipe and a plurality of sub sidewall holes piercing through the sub sidewall and protects the sub resource collection pipe. The sub filter is disposed on the inside of the sub protective pipe and removes sediment excavated from the seabed layer 18. The sub gate pipe is disposed at least one of on the outer side of the sub protective pipe and between the sub filter and the sub filter in order to open and close the plurality of sub sidewall holes.

By adopting such a configuration, the resource collection system of the present invention can collect resources from the seabed layer in a wide range. Therefore, the resource collection system can more efficiently collect resources from the seabed layer.

The resource collection system of the present invention opens the plurality of sub sidewall holes when collecting resources from the seabed layer 18 and closes the plurality of sub sidewall holes at times other than when collecting the resources. The resource collection pipe of the present invention includes the gas collection pipe 26 and the oil collection pipe 28. The sub resource collection pipe, the sub protective pipe, and the sub gate pipe are welded steel pipes like the tube outer wall 70.

<Coiled Tubing Device Disposition>

A plurality of the coiled tubing devices of the resource collection device 20 configuring the resource collection system of the present invention may be disposed in at least one position with respect to the axial direction of the protective pipe 22 at a predetermined interval in the circumferential direction of the positions.

By adopting such a configuration, the resource collection system of the present invention can collect resources from the seabed layer in a wide range. Therefore, the resource collection system can more efficiently collect resources from the seabed layer.

The number of coiled tubing devices 60 is not particularly limited if the coiled tubing devices 60 can be housed on the inside of the resource collection device 20.

Figure 11:
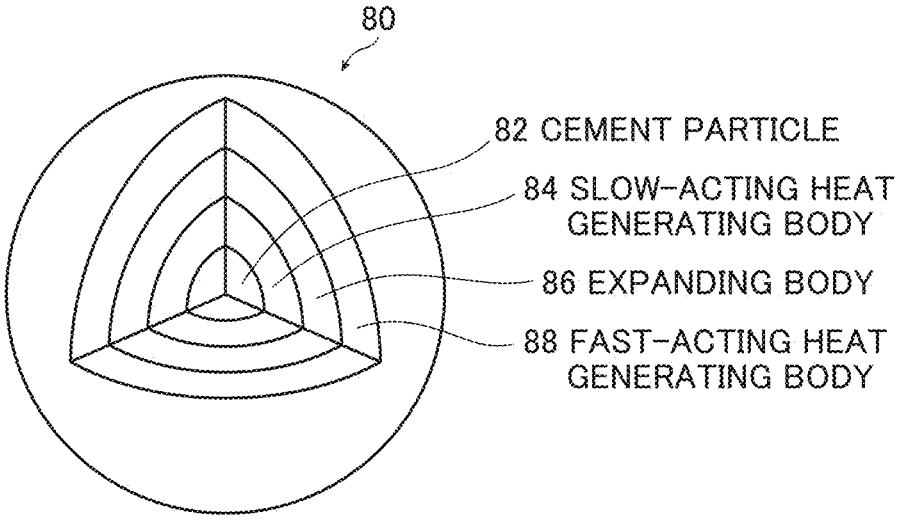
FIG. 11 is an image diagram of a crushed particle.
Figure 12A:
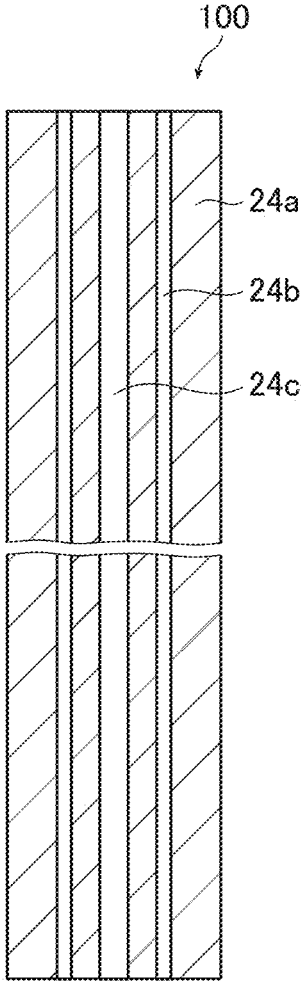
FIG. 12(*a*) is a longitudinal sectional view schematically showing an example of a filter configuring the resource collection device shown in FIG. 2, FIG. 12(*b*) is a cross sectional view of the filter, FIG. 12(*c*) is a longitudinal sectional view schematically showing a modification 1 of the filter, and FIG. 12(*d*) is a longitudinal sectional view schematically showing a modification 2 of the filter.
Figure 12C:
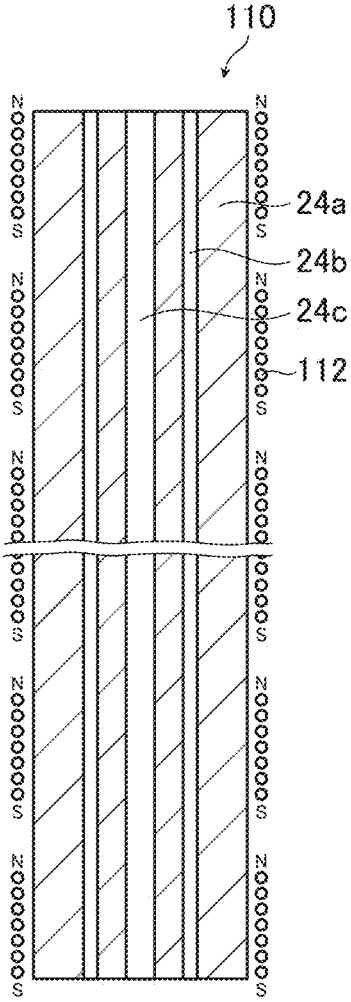
Figure 12D:
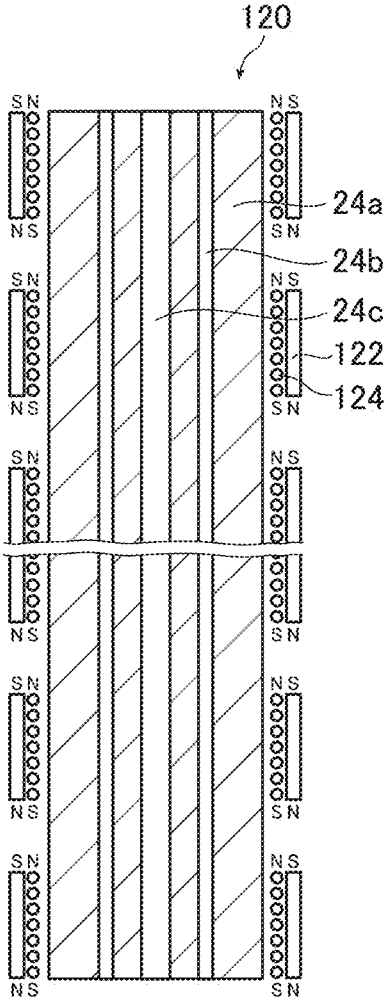
Figure 12B:
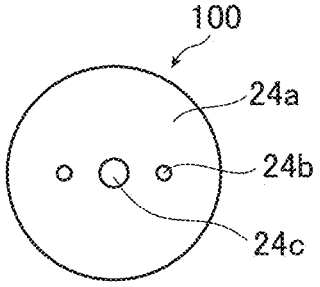

Subsequently, a crushed particle configuring the resource collection system in the first embodiment of the present invention is explained. FIG. 11 is an image diagram of the crushed particle.

<Crushed Particle>

A resource collection device 20 configuring the resource collection system of the present invention includes a high-pressure water supply pipe and a resource collection pipe. The high-pressure water supply pipe supplies high-pressure water into the seabed layer 18 in order to collect resources from the seabed layer 18. The resource collection pipe sends resources collected from the seabed layer 18 to the collected resource storage tank 12*a*. The resource collection system of the present invention mixes a crushed particle 80 in the high-pressure water in the high-pressure water supply pipe and crushes the seabed layer 18 with the high-pressure water mixed with the crushed particle 80. The crushed particle 80 is obtained by coating the outer side of a cement particle 82 with a slow-acting heat generating body 84, an expanding body 86, and a fast-acting heat generating body 88 in order. The slow-acting heat generating body 84 is obtained by baking, with a microwave, a material that absorbs moisture of the high-pressure water and generates heat. The expanding body 86 is formed by a material that absorbs the moisture of the high-pressure water and expands. The fast-acting heat generating body 88 is obtained by baking, with the microwave, the same material as the slow-acting heat generating body 84 for a shorter time than the slow-acting heat generating body 84 or not baking the material with the microwave. The resource collection pipe of the present invention includes the gas collection pipe 26 and the oil collection pipe 28.

By adopting such a configuration, the resource collection system of the present invention can heat the seabed layer in a wide range in a short time. Therefore, the resource collection system can more efficiently collect resources from the seabed layer.

The high-pressure water supply pipe of the present invention is connected to the water supply device 12*b* via a high-pressure pump. The crushed particle 80 is supplied from the crushed-particle supply device 12*g*. By expanding, using the expanding body 86, small cavities of the seabed layer 18 generated using the fast-acting heat generating body 88 and the slow-acting heat generating body 84, the cracks 18*a* for more efficiently collecting resources from the seabed layer 18 can be formed in the seabed layer 18. The fast-acting heat generating body 88 is a heat generating body for generating heat in approximately several minutes to several hours and melting ice of the seawater. The slow-acting heat generating body 84 is a heat generating body for generating heat in approximately several days to several weeks and melting solid resources such as a gas-hydrate layer. The crushed particle 80 may be stored by setting, on the inside of the storage tank 36, a region for temporarily storing the crushed particle 80. The crushed particle 80 may be supplied into the seabed layer using the coiled tubing device 60. In that case, the crushed particle 80 may be mixed in the high-pressure water in the high-pressure water supply pipe 68*e*. The slow-acting heat generating body 84 and the fast-acting heat generating body 88 are not particularly limited. However, it is preferable that the slow-acting heat generating body 84 and the fast-acting heat generating body 88 are heat generating bodies which cause, when iron powder comes into contact with the air and oxidize, chemical reaction to generate heat or heat generating bodies which cause calcium oxide and water to react to generate calcium hydroxide and cause, using heat energy generated at that time and alkali water solution as an initiator, aluminum and the calcium hydroxide to react. The expanding body 86 is not particularly limited. However, it is preferable that the expanding body 86 is an expanding body obtained by crushing a baked compound, which contains lime, plaster, and bauxite as main components, to have an appropriate particle size distribution or, in the case where calcium oxide and water react to be the calcium hydroxide, the expanding body 86 is a particle of the calcium hydroxide to be expanded.

Subsequently, a sediment discharging device configuring the resource collection device is explained.

<Sediment Discharge>

A resource collection device 20 configuring the resource collection system of the present invention includes the resource collection pipe, the protective pipe 22, and the filter 24. The resource collection pipe sends resources collected from the seabed layer 18 to the collected resource storage tank 12*a*. The protective pipe 22 is provided around the resource collection pipe and protects the resource collection pipe. The filter 24 is disposed on the inside of the protective pipe 22 and removes sediment excavated from the seabed layer 18. The resource collection system of the present invention pushes out, using a high-pressure pump, the sediment removed by the filter 24 from an opening of the sidewall 22*a* of the protective pipe 22 toward the seabed layer 18. The resource collection pipe of the present invention includes the gas collection pipe 26 and the oil collection pipe 28.

By adopting such a configuration, the resource collection system of the present invention does not store sediment. Therefore, the resource collection system can be reduced in size.

The resource collection device 20 includes a sediment discharging device 90. The sediment discharging device 90 includes an axial flow pump that rotates a spiral rotary wing to thereby move sediment removed by the filter 24 in the direction of the sidewall 22*a* of the protective pipe 22 and a high-pressure pump that pushes out the sediment from the opening of the sidewall 22*a* of the protective pipe 22 toward the seabed layer 18. The spiral rotary wing is driven by a hydraulic motor or an air motor. The sediment discharging device 90 may discharge an excess coating agent together with the sediment. It is preferable that the resource collection system of the present invention mixes cement particles in the sediment before discharging the sediment. A type of the high-pressure pump is not particularly limited. However, a plunger pump is preferable in terms of pressure for pushing out sediment. The number of sediment discharging devices 90 is not particularly limited if the sediment discharging devices 90 can be housed on the inside of the resource collection device 20.

Figure 13A:
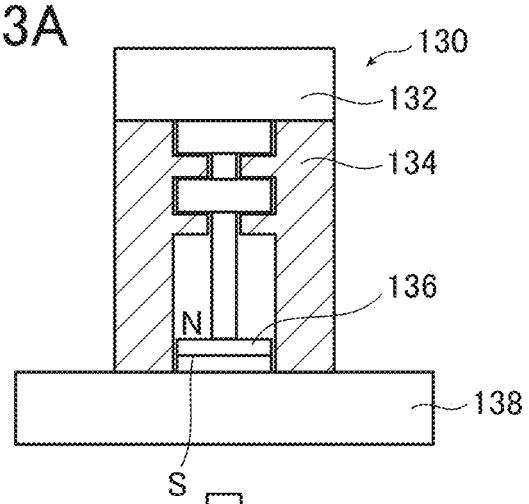
FIGS. 13(*a*) and 13(*b*) are longitudinal sectional views schematically showing movement of a permanent magnet.
Figure 13B:
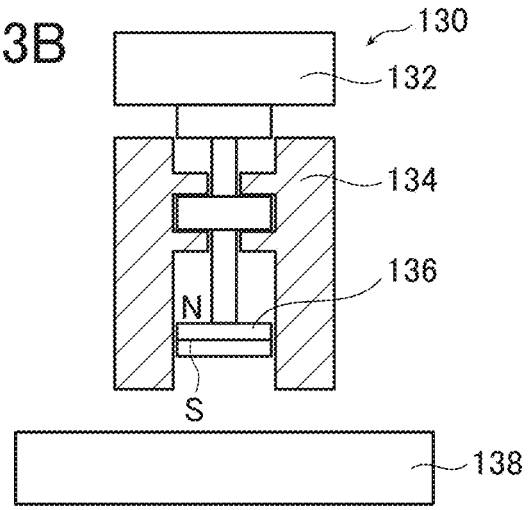
Figure 14A:
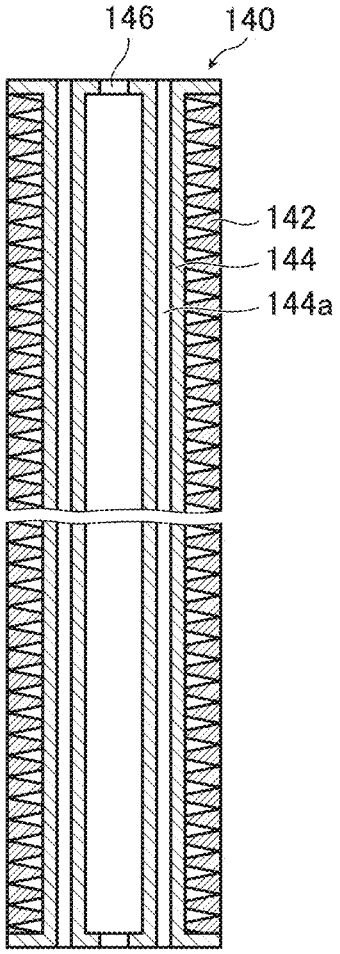
FIG. 14(*a*) is a longitudinal sectional view schematically showing a modification 3 of the filter, FIG. 14(*b*) is a cross sectional view of the modification 3, FIG. 14(*c*) is a longitudinal sectional view schematically showing a modification 4 of the filter, and FIG. 14(*d*) is a cross sectional view of the modification 4.
Figure 14C:
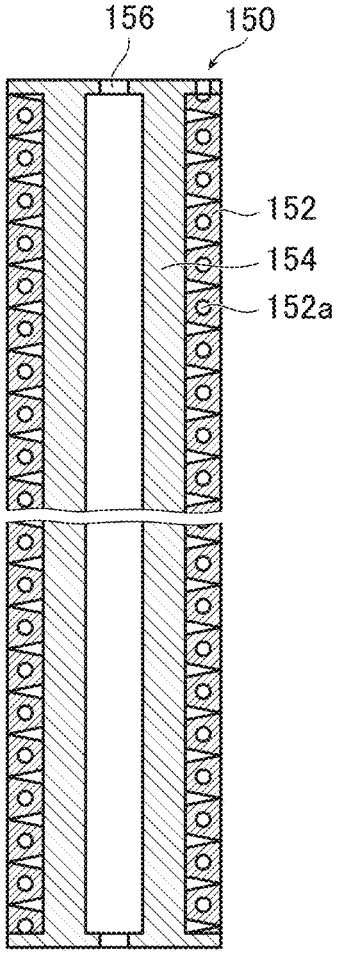
Figure 14B:
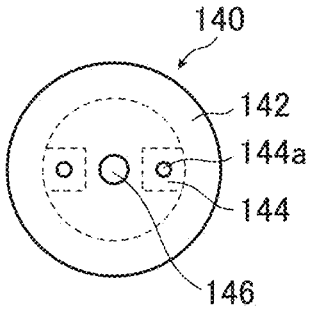
Figure 14D:
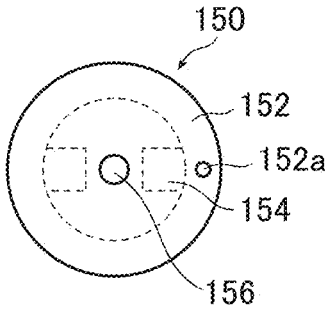

Subsequently, the filter configuring the resource collection device is explained. FIG. 12(*a*) is a longitudinal sectional view schematically showing an example of the filter configuring the resource collection device shown in FIG. 2. FIG. 12(*b*) is a cross sectional view of the filter. FIG. 12(*c*) is a longitudinal sectional view schematically showing a modification 1 of the filter. FIG. 12(*d*) is a longitudinal sectional view schematically showing a modification 2 of the filter. FIG. 13(*a*) and FIG. 13(*b*) are longitudinal sectional views schematically showing movement of a permanent magnet. FIG. 14(*a*) is a longitudinal sectional view schematically showing a modification 3 of the filter. FIG. 14(*b*) is a cross sectional view of the modification 3. FIG. 14(*c*) is a longitudinal sectional view schematically showing a modification 4 of the filter. FIG. 14(*d*) is a cross sectional view of the modification 4. A filter 100, which is an example of the filter, is the same as the filter 24 and the secondary filter 46 and includes the elements 24*a*, the resource collection hole 24*b*, and the through-hole 24*c*.

<Electromagnet>

A resource collection device 20 configuring the resource collection system of the present invention includes the resource collection pipe, the protective pipe 22, and a filter 110. The resource collection pipe sends resources collected from the seabed layer 18 to the collected resource storage tank 12*a*. The protective pipe 22 is provided around the resource collection pipe and protects the resource collection pipe. The filter 110 is disposed on the inside of the protective pipe 22 and removes sediment excavated from the seabed layer 18. The filter 110 includes an electromagnet coil 112 disposed on the inside of the elements 24*a* to hold diatomaceous earth with magnetic body powder. The resource collection system of the present invention energizes the electromagnet coil 112 to thereby generate a holding force for the diatomaceous earth with magnetic body powder by the electromagnet coil 112. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

The filter 110 is a modification 1 of the filter and further includes the resource collection hole 24*b* and the through-hole 24*c*. The length and the number of electromagnet coils 112 are not particularly limited if resources can be collected from the surfaces of the elements 24*a* among the electromagnet coils 112.

<Permanent Magnet>

A resource collection device 20 configuring the resource collection system of the present invention includes the resource collection pipe, the protective pipe 22, and a filter 120. The resource collection pipe sends resources collected from the seabed layer 18 to the collected resource storage tank 12*a*. The protective pipe 22 is provided around the resource collection pipe and protects the resource collection pipe. The filter 120 is disposed on the inside of the protective pipe 22 and removes sediment excavated from the seabed layer 18. The filter 120 includes a permanent magnet 122 and demagnetizing means. The permanent magnet 122 is disposed on the inside of the elements 24*a* to hold diatomaceous earth with magnetic body powder. The demagnetizing means weakens a holding force for the diatomaceous earth with magnetic body powder by the permanent magnet 122. The resource collection system of the present invention actuates the demagnetizing means to reduce an amount of the diatomaceous earth with magnetic body powder held by the permanent magnet 122. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

The filter 120 is a modification 2 of the filter and further includes the resource collection hole 24*b* and the through-hole 24*c*. The length and the number of permanent magnets 122 are not particularly limited if resources can be collected from the surfaces of the elements 24*a* among the permanent magnets 122. A type of the permanent magnet 122 is not particularly limited. However, the permanent magnet 122 is preferably a neodymium magnet.

<Permanent Magnet and Electromagnet>

The demagnetizing means of the resource collection device 20 configuring the resource collection system of the present invention may be an electromagnet coil 124 disposed on the inner side or the outer side of the permanent magnet 122 such that poles opposite to poles of the permanent magnet 122 are respectively adjacent to the poles. The resource collection system of the present invention may energize the electromagnet coil 124 to thereby reduce an amount of the diatomaceous earth with magnetic body powder held by the permanent magnet 122.

By adopting such a configuration, the resource collection system of the present invention less easily breaks down. Therefore, the resource collection system can stably operate continuously for a long time.

The length and the number of electromagnet coils 124 are not particularly limited if resources can be collected from the surfaces of the elements 24*a* among the electromagnet coils 124.

Demagnetizing means 130 includes an operation section 132, a main body 134, and a permanent magnet 136. When the operation section 132 is pushed into the main body 134 and then the main body 134 is put on a target object 138, an attraction force acts between the permanent magnet 136 on the inside of the main body 134 and the target object 138. The target object 138 can be lifted by lifting the main body 134. However, when the operation section 132 is lifted in this state, the operation section 132 is separated from the main body 134 and the permanent magnet 136 is separated from the target object 138. Therefore, the target object 138 can be removed from the main body 134. An amount of the diatomaceous earth with magnetic body powder held by the permanent magnet 122 may be reduced by moving the position of the permanent magnet 122 using this method as demagnetizing means.

<Metal Wire Filter, Fiber-Like Metal Filter>

A resource collection device 20 configuring the resource collection system of the present invention includes the resource collection pipe, the protective pipe 22, and a filter 140. The resource collection pipe sends resources collected from the seabed layer 18 to the collected resource storage tank 12*a*. The protective pipe 22 is provided around the resource collection pipe and protects the resource collection pipe. The filter 140 is disposed on the inside of the protective pipe 22 and removes sediment excavated from the seabed layer 18. The filter 140 includes a spiral metal wire 142 and a column 144. The column 144 extends in a straight-axis direction of the spiral metal wire 142 and is fixed to the spiral metal wire 142. The resource collection system of the present invention prevents freezing of the seawater on the surface of the spiral metal wire 142 by feeding high-pressure hot water or high-pressure steam into a through-hole 144*a* in the longitudinal direction of the column 144. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

The through-hole 144*a* corresponds to the through-hole 24*c* in terms of a function. The filter 140 is a modification 3 of the filter and further includes a resource collection hole 146 corresponding to the resource collection hole 24*b* in terms of a function. The spiral through-hole can be configured by a method of filling up a plurality of thin tubes with wax, closing both ends of the thin tubes, loading explosive around the thin tubes, and igniting the explosive, and welding the thin tubes to one another with a shock of the explosion. The shape of the column 144 is not particularly limited if the spiral metal wire 142 can be fixed. The size and the number of columns 144 are not particularly limited if the columns 144 do not affect the performance of the filter 140. The shape, the size, and the number of resource collection holes 146 are not particularly limited. However, it is preferable that the shape, the size, and the number are optimized such that resources can be most efficiently collected. The shape, the size, and the number of through-holes 144*a* are not particularly limited. However, it is preferable that the shape, the size, and the number are optimized such that heating can be most efficiently performed. The materials of the spiral metal wire 142 and the column 144 are not particularly limited. However, it is preferable that the materials are iron or stainless steel.

The resource collection device 20 configuring the resource collection system of the present invention includes the resource collection pipe, the protective pipe 22, and a filter 150. The resource collection pipe sends resources collected from the seabed layer 18 to the collected resource storage tank 12*a*. The protective pipe 22 is provided around the resource collection pipe and protects the resource collection pipe. The filter 150 is disposed on the inside of the protective pipe 22 and removes sediment excavated from the seabed layer 18. The filter 150 includes a spiral metal wire 152 and a column 154. The column 154 extends in the straight-axis direction of the spiral metal wire 152 and is fixed to the spiral metal wire 152. The resource collection system of the present invention prevents freezing of the seawater on the surface of the spiral metal wire 152 by feeding high-pressure hot water or high-pressure steam into a spiral through-hole 152*a* of the spiral metal wire 152. The resource collection pipe of the present invention includes the gas collection pipe 26 and the oil collection pipe 28.

By adopting such a configuration, the resource collection system of the present invention less easily breaks down. Therefore, the resource collection system can stably operate continuously for a long time.

The through-hole 152*a* corresponds to the through-hole 24*c* in terms of a function. The filter 150 is a modification 4 of the filter and further includes a resource collection hole 156 corresponding to the resource collection hole 24*b* in terms of a function. The spiral through-hole can be configured by a method of filling up a plurality of thin tubes with wax, closing both ends of the thin tubes, loading explosive around the thin tubes, and igniting the explosive, and welding the thin tubes to one another with a shock of the explosion. The shape of the column 154 is not particularly limited if the spiral metal wire 152 can be fixed. The size and the number of columns 154 are not particularly limited if the columns 154 do not affect the performance of the filter 150. The shape, the size, and the number of resource collection holes 156 are not particularly limited. However, it is preferable that the shape, the size, and the number are optimized such that resources can be most efficiently collected. The shape, the size, and the number of through-holes 152*a* are not particularly limited. However, it is preferable that the shape, the size, and the number are optimized such that heating can be most efficiently performed. The materials of the spiral metal wire 152 and the column 154 are not particularly limited. However, it is preferable that the materials are iron or stainless steel.

The filter 150 may include, instead of the spiral metal wire 152 and the column 154, an object obtained by stacking and compressing fiber-like metal entangled like cotton. The resource collection system of the present invention prevents freezing of the seawater on the surface and the inside of the filter by feeding high-pressure hot water or high-pressure steam into the through-hole 24*c* in the longitudinal direction of the filter. The fiber-like metal filter further includes the resource collection hole 24*b*. The fiber-like metal is preferably steel wool or stainless wool. The resource collection hole 24*b* and the through-hole 24*c* can be configured by a method of, when stacking the fiber-like metal, inserting a bar material in the longitudinal direction of the filter and pulling out the bar material after compression of the entire fiber-like metal.

Figure 15A:
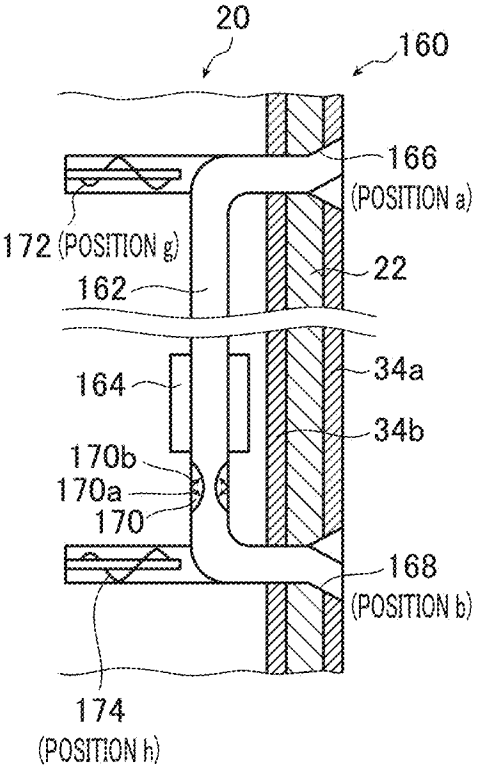
FIG. 15(*a*) is a partial longitudinal sectional view schematically showing a function of a circulating flow generation pipe configuring the resource collection device shown in FIG. 2, and FIGS. 15(*b*) and 15(*c*) are partial longitudinal sectional views schematically showing movement of the circulating flow generation pipe.
Figure 15B:
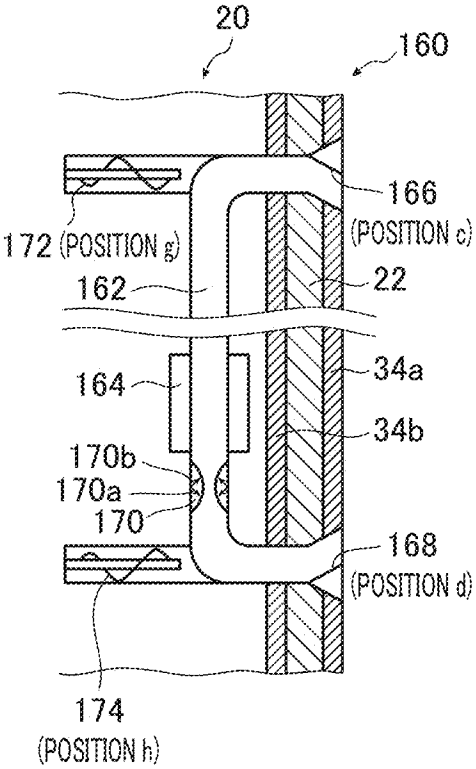
Figure 15C:
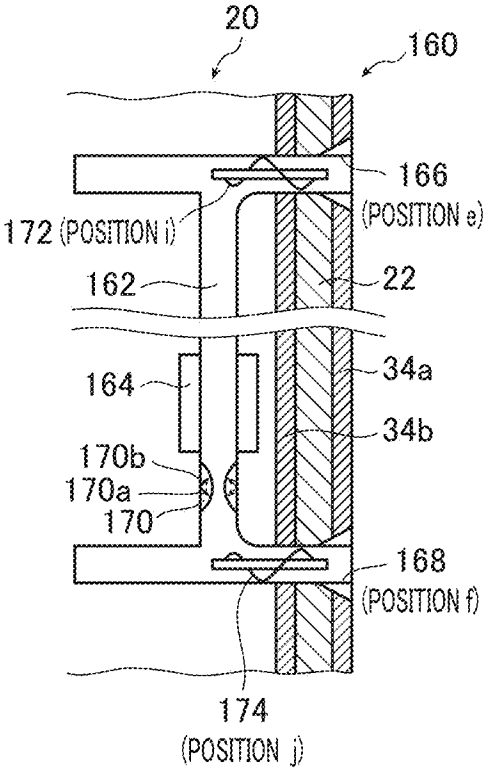

Subsequently, a circulating-flow generation device configuring the resource collection device is explained. FIG. 15(*a*) is a partial longitudinal sectional view schematically showing a function of a circulating flow generation pipe configuring the resource collection device shown in FIG. 2. FIGS. 15(*b*) and 15(*c*) are partial longitudinal sectional views schematically showing movement of the circulating flow generation pipe.

<Circulating Flow Movable Pipe>

A resource collection device 20 configuring the resource collection system of the present invention includes the resource collection pipe, the protective pipe 22, a circulating flow generation pipe 162, and a power supply device. The resource collection pipe sends resources collected from the seabed layer 18 to the collected resource storage tank 12*a*. The protective pipe 22 is provided around the resource collection pipe and protects the resource collection pipe. The circulating flow generation pipe 162 is provided in a U shape on the inside of the protective pipe 22 and generates a circulating flow between the seabed layer 18 and the protective pipe 22. The power supply device supplies electric power to a high-frequency heater 164 disposed halfway in the circulating flow generation pipe 162. When an amount of resources collected from the seabed layer 18 decreases, the resource collection system of the present invention changes angles of movable pipes 166 and 168 provided at both ends of the circulating flow generation pipe 162 to thereby shorten a channel of the circulating flow and jet high-pressure hot water or high-pressure steam from the movable pipes 166 and 168 toward the seabed layer 18. The resource collection pipe of the present invention includes the gas collection pipe 26 and the oil collection pipe 28.

By adopting such a configuration, the resource collection system of the present invention can heat the seabed layer in the periphery in a short time. Therefore, the resource collection system can more efficiently collect resources from the seabed layer.

The circulating flow generation pipe 162 and the power supply device configure a circulating-flow generation device 160. The high-pressure hot water or the high-pressure steam are supplied from the water supply device 12*b* via the power supply device and a high-pressure pump and may be supercritical water. A position of the movable pipe 166 at the time when an amount of resources collected from the seabed layer 18 is normal is an upward position "a". A position of the movable pipe 168 at the time when the amount of resources collected from the seabed layer 18 is normal is a downward position "b". A position of the movable pipe 166 at the time when the amount of resources collected from the seabed layer 18 decreases is a downward position "c". A position of the movable pipe 168 at the time when the amount of resources collected from the seabed layer 18 decreases is an upward position "d". The number of circulating-flow generation devices 160 is not particularly limited if the circulating-flow generation devices 160 can be housed on the inside of the resource collection device 20. The shape of the movable pipes 166 and 168 is not particularly limited if a direction of the circulating flow can be changed.

In order to generate a circulating flow between the seabed layer 18 and the protective pipe 22, steam is jetted into the circulating flow generation pipe 162 through a downward steam jetting hole 170*a* or an upward steam jetting hole 170*b* of a steam jetting section 170 disposed halfway in the circulating flow generation pipe 162. A high-frequency heater 164 further heats the steam to generate overheated steam. Note that a high-frequency electromagnetic wave used here is preferably a high-frequency electromagnetic wave with a frequency of several hundred megahertz to several ten terahertz. In particular, an electromagnetic wave with a frequency of several hundred to several thousand megahertz used for decomposition of gas hydrate and an electromagnetic wave with a frequency of several ten terahertz which deeply penetrates into gas hydrate and has decomposition promotion action for gas hydrate may be combined as appropriate and used.

<Forced Circulation>

A resource collection device 20*m* configuring the resource collection system of the present invention includes the resource collection pipe, the protective pipe 22, the circulating flow generation pipe 162, and the power supply device. The resource collection pipe sends resources collected from the seabed layer 18 to the collected resource storage tank 12*a*. The protective pipe 22 is provided around the resource collection pipe and protects the resource collection pipe. The circulating flow generation pipe 162 is provided in a U shape on the inside of the protective pipe 22 and generates a circulating flow between the seabed layer 18 and the protective pipe 22. The power supply device supplies electric power to a high-frequency heater 164 disposed halfway in the circulating flow generation pipe 162. When a flow rate of the circulating flow decreases, the resource collection system of the present invention rotates spiral rotary wings 172 and 174 to thereby move sediment in the circulating flow generation pipe 162 in the direction of the circulating flow. The resource collection pipe of the present invention includes the gas collection pipe 26 and the oil collection pipe 28.

By adopting such a configuration, the resource collection system of the present invention can heat the seabed layer in the periphery in a short time. Therefore, the resource collection system can more efficiently collect resources from the seabed layer.

A position of the spiral rotary wing 172 of the axial flow pump at the time when a flow rate of the circulating flow is normal is a position "g" on the outside of the circulating flow generation pipe 162. A position of the spiral rotary wing 174 at the time when the flow rate of the circulating flow is normal is a position "h" on the outside of the circulating flow generation pipe 162. A position of the movable pipe 166 at the time when the flow rate of the circulating flow decreases is a horizontal position "e". A position of the movable pipe 168 at the time when the flow rate of the circulating flow decreases is a horizontal position "f". A position of the spiral rotary wing 172 of the axial flow pump at the time when the flow rate of the circulating flow decreases is a position "i" on the inside of the circulating flow generation pipe 162. A position of the spiral rotary wing 174 at the time when the flow rate of the circulating flow decreases is a position "j" on the inside of the circulating flow generation pipe 162. The spiral rotary wings 172 and 174 are driven by a hydraulic motor or an air motor.

<Cement Particles>

Before moving the protective pipe 22 in the axial direction with respect to the seabed layer 18, the resource collection system of the present invention may supply cement particles into the seabed layer 18 in two opening positions of the circulating flow generation pipe 162.

By adopting such a configuration, the resource collection system of the present invention less easily breaks down. Therefore, the resource collection system can stably operate continuously for a long time.

The cement particles are supplied from the cement-particle supply device 12*h*.

Figure 16A:
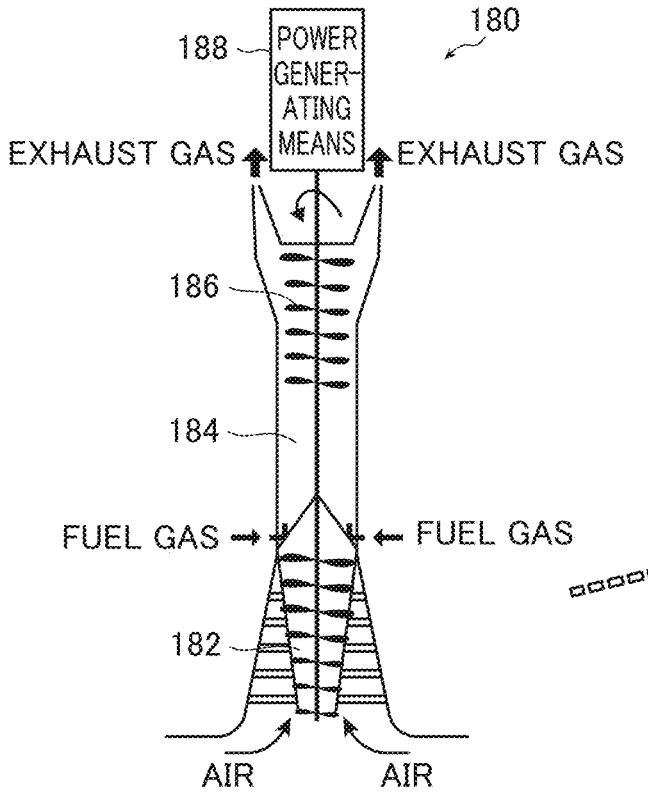
FIG. 16(*a*) is a longitudinal sectional view schematically showing an example of a power supply device configuring the resource collection device shown in FIG. 2, FIG. 16(*b*) is a longitudinal sectional view schematically showing a modification 1 of a part of the power supply device, and FIG. 16(*c*) is a longitudinal sectional view schematically showing a modification 2 of the power supply device.
Figure 16B:
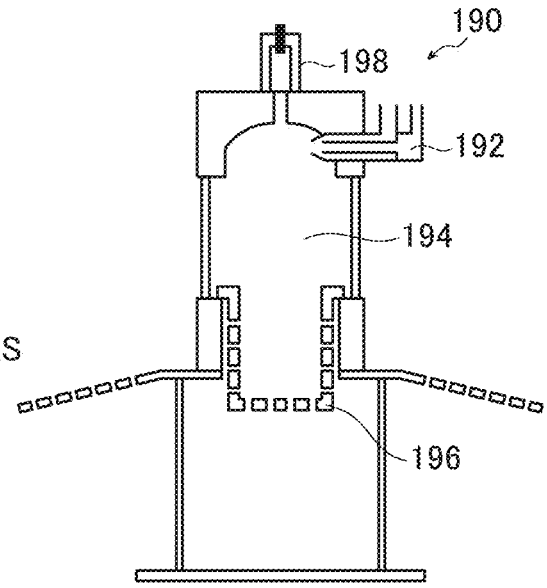
Figure 16C:
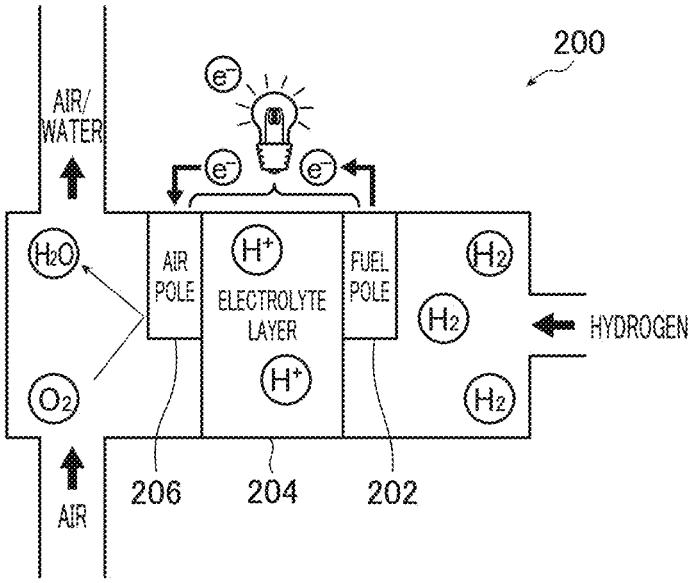

Subsequently, the power supply device configuring the resource collection device is explained. FIG. 16(*a*) is a longitudinal sectional view schematically showing an example of the power supply device configuring the resource collection device shown in FIG. 2. FIG. 16(*b*) is a longitudinal sectional view schematically showing a modification 1 of a part of the power supply device. FIG. 16(*c*) is a longitudinal sectional view schematically showing a modification 2 of the power supply device.

<Jet Turbine>

A jet turbine 180 is an example of the power supply device and includes a compressing section 182, a combustion chamber 184, a turbine 186, and power generating means 188. The compressing section 182 compresses taken-in air. The combustion chamber 184 stores mixed gas of fuel gas being burned and the compressed air. The turbine 186 rotates with a blade receiving flowing force of gas expanded by combustion. The power generating means 188 generates power with the rotation of the turbine 186.

A resource collection device 20 configuring the resource collection system of the present invention includes the resource collection pipe, the protective pipe 22, the circulating flow generation pipe 162, and the power supply device. The resource collection pipe sends resources collected from the seabed layer 18 to the collected resource storage tank 12*a*. The protective pipe 22 is provided around the resource collection pipe and protects the resource collection pipe. The circulating flow generation pipe 162 is provided in a U shape on the inside of the protective pipe 22 and generates a circulating flow between the seabed layer 18 and the protective pipe 22. The power supply device supplies electric power to a high-frequency heater 164 disposed halfway in the circulating flow generation pipe 162. The power supply device includes a jet turbine 180. The jet turbine 180 is driven by combustion gas generated by burning resources collected from the seabed layer 18 in the combustion chamber 184 and supplies high-pressure hot water or high-pressure steam to the circulating flow generation pipe 162. The resource collection pipe of the present invention includes the gas collection pipe 26 and the oil collection pipe 28.

By adopting such a configuration, since a setting place of the resource collection system of the present invention is by far closer than the sea surface, the resource collection system can more efficiently supply necessary energy.

The high-pressure hot water or the high-pressure steam may be supercritical water. The fuel gas is supplied to the combustion chamber 184 through the gas collection pipe 26 or the oil collection pipe 28. The air is supplied from the air supply device 12*d* to the compressing section 182 through the air supply pipe 42*c*. Gas after combustion is discharged to the atmosphere on the sea surface through the exhaust gas recovery pipe 42*d*. The number of power supply devices is not particularly limited if the power supply devices can be housed on the inside of the resource collection device 20.

<Submerged Burner>

A submerged burner 190 is a modification 1 of a part of the power supply device and includes a nozzle 192, a combustion chamber 194, a combustion stabilizer 196, and an ignition device 198. The nozzle 192 blows the fuel gas and pressurized air into the combustion chamber 194 in a tangential direction. The combustion chamber 194 stores mixed gas of the fuel gas being burned and the pressurized air. The combustion stabilizer 196 prevents destabilizing of combustion due to a backflow of liquid to the combustion chamber 194. The ignition device 198 ignites the mixed gas of the fuel gas and the pressurized air. The blade receives flowing force of gas expanded by combustion of the mixed gas and the turbine rotates. Power generating means generates power according to the rotation of the turbine.

A resource collection device 20 configuring the resource collection system of the present invention includes the resource collection pipe, the protective pipe 22, the circulating flow generation pipe 162, and the power supply device. The resource collection pipe sends resources collected from the seabed layer 18 to the collected resource storage tank 12*a*. The protective pipe 22 is provided around the resource collection pipe and protects the resource collection pipe. The circulating flow generation pipe 162 is provided in a U shape on the inside of the protective pipe 22 and generates a circulating flow between the seabed layer 18 and the protective pipe 22. The power supply device supplies electric power to a high-frequency heater 164 disposed halfway in the circulating flow generation pipe 162. The power supply device includes a turbine. The turbine is driven by combustion gas and steam generated by burning, with the submerged burner 190, resources collected from the seabed layer 18 and supplies high-pressure hot water or high-pressure steam to the circulating flow generation pipe 162. The resource collection pipe of the present invention includes the gas collection pipe 26 and the oil collection pipe 28.

By adopting such a configuration, since a setting place of the resource collection system of the present invention is by far closer than the sea surface, the resource collection system can more efficiently supply necessary energy.

The high-pressure hot water or the high-pressure steam may be supercritical water. The fuel gas is supplied to the combustion chamber 194 through the gas collection pipe 26 or the oil collection pipe 28. The air is supplied from the air supply device 12*d* to the combustion chamber 194 through the air supply pipe 42*c*. Gas after combustion is discharged to the atmosphere on the sea surface through the exhaust gas recovery pipe 42*d*.

<Fuel Cell, Thermoelectric Conversion Device>

A fuel cell 200 is a modification 2 of the power supply device and includes a fuel pole 202, an electrolyte layer 204, and an air pole 206. Hydrogen supplied to the fuel pole 202 intrudes to a surface in contact with the electrolyte layer 204 and separates electrons to be hydrogen ions. The electrons exit to the outside. The hydrogen ions moved in the electrolyte layer 204 reacts with oxygen supplied to the air pole 206 and the electrons returned from the outside to be water.

A resource collection device 20 configuring the resource collection system of the present invention includes the resource collection pipe, the protective pipe 22, the circulating flow generation pipe 162, and the power supply device. The resource collection pipe sends resources collected from the seabed layer 18 to the collected resource storage tank 12*a*. The protective pipe 22 is provided around the resource collection pipe and protects the resource collection pipe. The circulating flow generation pipe 162 is provided in a U shape on the inside of the protective pipe 22 and generates a circulating flow between the seabed layer 18 and the protective pipe 22. The power supply device supplies electric power to a high-frequency heater 164 disposed halfway in the circulating flow generation pipe 162. The power supply device is the fuel cell 200 that supplies electric power using hydrogen obtained by causing the resources collected from the seabed layer 18 and high-temperature steam to react. The resource collection pipe of the present invention includes the gas collection pipe 26 and the oil collection pipe 28.

By adopting such a configuration, since a setting place of the resource collection system of the present invention is by far closer than the sea surface, the resource collection system can more efficiently supply necessary energy.

The resources necessary for the reaction for obtaining the hydrogen are supplied through the gas collection pipe 26 or the oil collection pipe 28. The high-temperature steam is supplied from the water supply device 12*b* via a heater. Air and water generated after the power supply reaction are reused in the resource collection device 20. The power supply device may be, instead of the fuel cell 200, a thermoelectric conversion device that converts heat of a hydrothermal deposit in the seabed layer 18 into electric power and supplies the electric power. The thermoelectric conversion device is a device that, using the Seebeck effect, brings one of joining points into contact with a high heat source and brings the other into contact with a low heat source to cause a potential different and converts thermal energy into electric energy. The thermoelectric conversion device may be provided near the distal end of the coiled tubing device 60 extended by drilling the seabed layer 18 to near the hydrothermal deposit using a small drilling device provided at the distal end. In that case, it is preferable that the high heat source is the hydrothermal deposit in the seabed layer 18 and the low heat source is the seabed layer 18 sufficiently separated from the hydrothermal deposit.

The resource collection system in the first embodiment of the present invention is basically configured as explained above. By adopting such a configuration, the resource collection system of the present invention can more efficiently collect resources from the seabed layer, can stably operate continuously for a time equal to or longer than in the past, can more efficiently supply necessary energy, and can be reduced in size.

Figure 17:
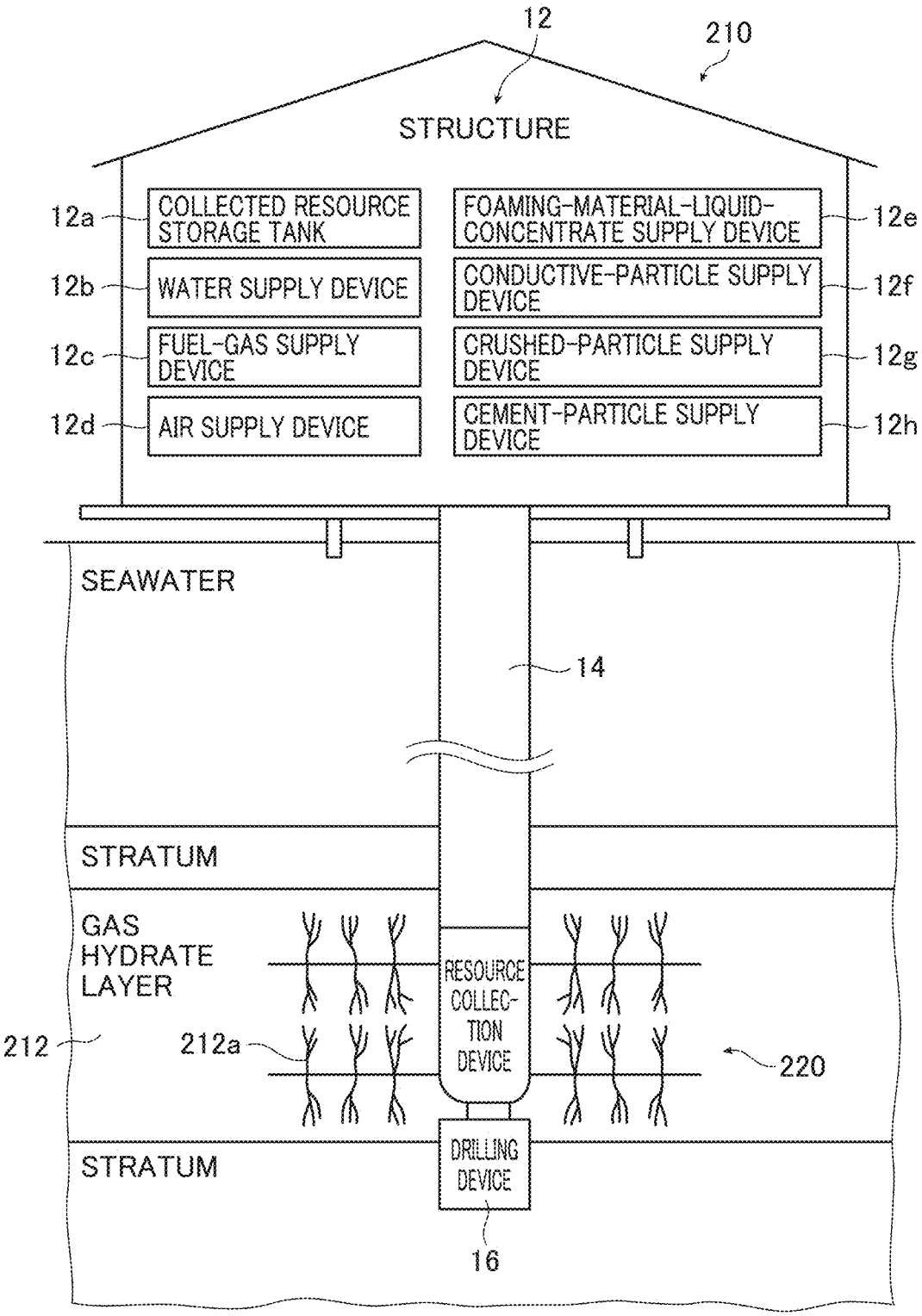
FIG. 17 is a block diagram schematically showing an overall configuration including a resource collection system in a second embodiment of the present invention.

Subsequently, an overall configuration including a resource collection system in a second embodiment of the present invention is explained. FIG. 17 is a block diagram schematically showing an overall configuration including the resource collection system in the second embodiment of the present invention.

An overall configuration 210 includes the structure 12 disposed on the sea surface, the connection pipe 14 extending downward from the structure 12, the drilling device 16 provided at the lower end of the connection pipe 14, and a resource collection device 220 provided between the connection pipe 14 and the drilling device 16. The resource collection device 220 collects resources using cracks 212*a* formed when a seabed layer 212 including a gas-hydrate layer or the like is crushed.

Figure 18B:
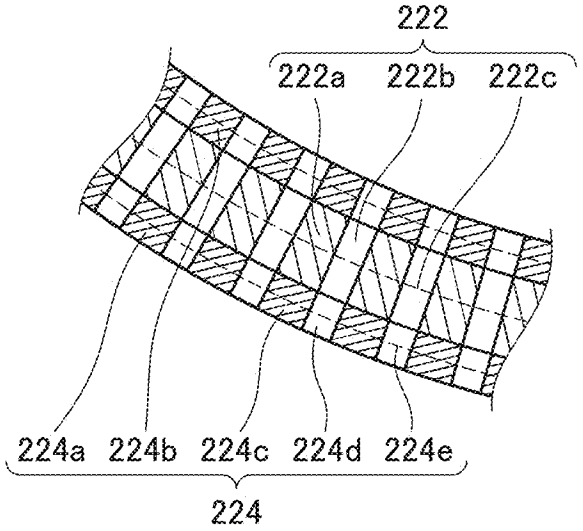
FIG. 18(*a*) is a longitudinal sectional view schematically showing a function of a resource collection device configuring the resource collection system shown in FIG. 17, and FIG. 18(*b*) is a partial longitudinal sectional view schematically showing a function of a bottom wall of a protective pipe configuring the resource collection device shown in FIG. 18(*a*) and the periphery of the bottom wall.
Figure 18A:
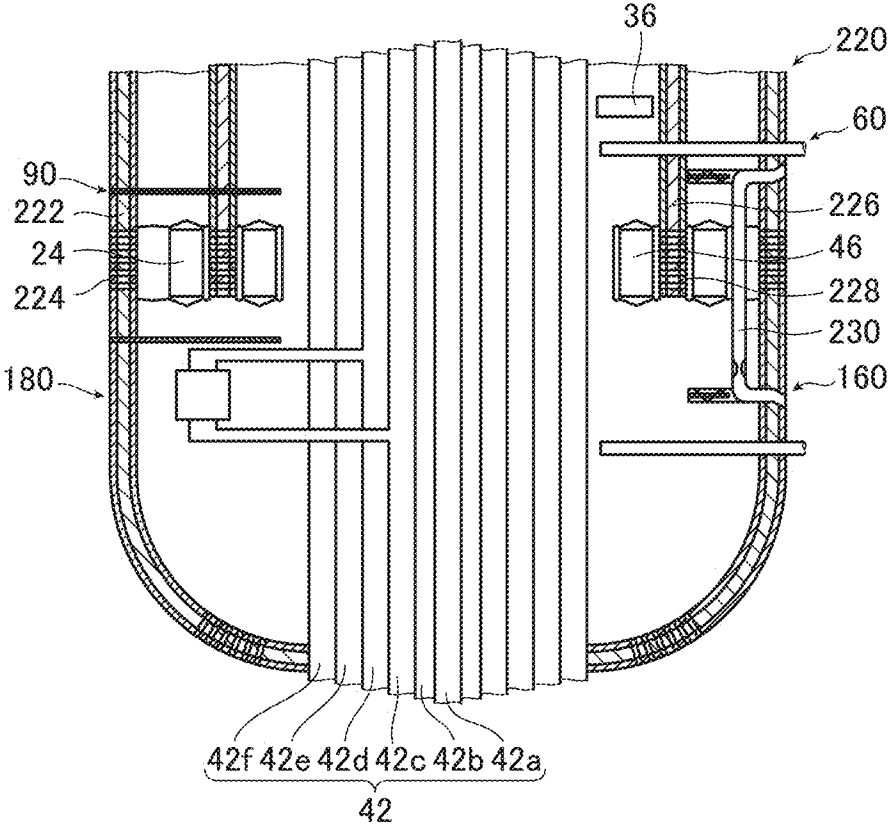

Subsequently, the resource collection system in the second embodiment of the present invention is explained with reference to the resource collection device configuring the resource collection system. FIG. 18(*a*) is a longitudinal sectional view schematically showing a function of the resource collection device configuring the resource collection system shown in FIG. 17. FIG. 18(*b*) is a partial longitudinal sectional view schematically showing a function of a bottom wall of a protective pipe configuring the resource collection device shown in FIG. 18(*a*) and the periphery of the bottom wall.

The resource collection device 220 configuring the resource collection system of the present invention includes the resource collection pipe, a protective pipe 222, the filter 24, a gate pipe 224, a secondary protective pipe 226, the secondary filter 46, a secondary gate pipe 228, a circulating flow generation pipe 230, and a power supply device. The resource collection pipe of the present invention includes the gas collection pipe 26 and the oil collection pipe 28. The resource collection device 220 has the same configuration except that shapes of the protective pipe 222 and the gate pipe 224 are different from the shapes of the protective pipe 22 and the gate pipe 34 of the resource collection apparatus 20 and the like, the numbers of stages in the longitudinal direction of the filter 24 and the secondary filter 46 are different, and the lengths in the axial direction of the secondary protective pipe 226, the secondary gate pipe 228, and the circulating flow generation pipe 230 are different from the lengths of the secondary protective pipe 44, the secondary gate pipe 48, and the circulating flow generation pipe 162 of the resource collection device 20 and the like. Therefore, explanation of the same components and components different only in the number of stages and the length is omitted.

<Semispherical Bottom Wall>

The protective pipe 222 of the resource collection device 220 configuring the resource collection system of the present invention may include a semispherical bottom wall 222*a* extending from one end of the sidewall and a plurality of bottom wall holes 222*b* piercing through the bottom wall 222*a*.

By adopting such a configuration, the resource collection system of the present invention can collect resources from a closer seabed layer. Therefore, the resource collection system can more efficiently collect resources from the seabed layer.

The resource collection system of the present invention opens the plurality of bottom wall holes 222*b* when collecting resources from the seabed layer 18 and closes the bottom wall holes 222*b* at times other than when collecting resources. The sidewall of the protective pipe 222 is different from the sidewall 22*a* only in the length in the axial direction. The protective pipe 222 further includes the plurality of sidewall holes 22*b* and a through-hole in the axial direction of the sidewall of the protective pipe 222. The plurality of sidewall holes 22*b* of the protective pipe 222 are different from the protective pipe 22 only in the number of stages in the axial direction and pierce through the sidewall of the protective pipe 222. The through-hole of the protective pipe 222 is different from the through-hole 22*c* only in the length in the axial direction and is connected to a through-hole 222*c* of the bottom wall 222*a*. The shape, the size, and the number of through-holes 222*c* are not particularly limited. However, it is preferable that the shape, the size, and the number are optimized such that heating can be most efficiently performed.

The gate pipe 224 of the resource collection device 220 includes a semispherical bottom wall 224*c* extending from one end of the sidewall and a plurality of bottom wall holes 224*d* piercing through the bottom wall 224*c*. The resource collection system of the present invention opens the plurality of bottom wall holes 224*d* when collecting resources from the seabed layer 18 and closes the plurality of bottom wall holes 224*d* other than when collecting resources. The sidewall of the gate pipe 224 is different from the sidewall 34*c* only in the length in the axial direction. The gate pipe 224 further includes the plurality of sidewall holes 34*d* and a through-hole in the axial direction of the sidewall of the gate pipe 224. The plurality of sidewall holes 34*d* of the gate pipe 224 are different from the gate pipe 34 only in the number of stages in the axial direction and pierce through the sidewall of the gate pipe 224. The through-hole of the gate pipe 224 is different from the through-hole 34*e* only in the length in the axial direction and is connected to a through-hole 224*e* of the bottom wall 224*c*. The shape, the size, and the number of through-holes 224*e* are not particularly limited. However, it is preferable that the shape, the size, and the number are optimized such that heating can be most efficiently performed.

A part of the gate pipe 224 disposed on the outer side of the protective pipe 222 is an outer gate pipe 224*a*. A part of the gate pipe 224 disposed between the protective pipe 222 and the filter 24 is an inner gate pipe 224*b*. Each of the outer gate pipe 224*a* and the inner gate pipe 224*b* includes the bottom wall 224*c*, the plurality of bottom wall holes 224*d* piercing through the bottom wall 224*c*, and the through-hole 224*e* in the axial direction of the bottom wall 224*c*. When the size of the bottom wall holes 224*d* is substantially the same as the size of the bottom wall holes 222*b* of the protective pipe 222 and the length of the bottom wall holes 224*d* in the circumferential direction of the gate pipe 224 is smaller than a half of a pitch in the circumferential direction, the bottom wall holes 222*b* of the protective pipe 222 can be closed by rotating the gate pipe 224 by the length of the bottom wall holes 224*d* using a hydraulic motor or an air motor. The shapes, the sizes, and the numbers of bottom wall holes 222*b* and bottom wall holes 224*d* are not particularly limited. However, it is preferable that the shapes, the sizes, and the numbers are optimized such that resources can be most efficiently collected.

The resource collection system in the second embodiment of the present invention is basically configured as explained above. By adopting such a configuration, the resource collection system of the present invention can more efficiently collect resources from the seabed layer, can stably operate continuously for a time equal to or longer than in the past, can more efficiently supply necessary energy, and can be reduced in size.

The resource collection system of the present invention is explained in detail above. However, the present invention is not limited to the above description. It goes without saying that various improvements and changes may be made in a range not departing from the gist of the present invention.

INDUSTRIAL APPLICABILITY

The resource collection system of the present invention has, in addition to an effect that the resource collection system can more efficiently collect resources from the seabed layer, an effect that the resource collection system can stably operate continuously for a time equal to or longer than in the past, can more efficiently supply necessary energy, and can be reduced in size. Therefore, the resource collection system is useful in industries.

DESCRIPTION OF SYMBOLS

10, 210 overall configuration
12 structure
12*a* collected resource storage tank
12*b* water supply device
12*c* fuel-gas supply device
12*d* air supply device
12*e* foaming-material-liquid-concentrate supply device
12*f* conductive-particle supply device
12*g* crushed-particle supply device
12*h* cement-particle supply device
14 connection pipe
16 drilling device
18, 212 seabed layer
18*a*, 212*a* crack
20, 220 resource collection device
22, 222 protective pipe
22*a*, 34*c* sidewall
22*b*, 34*d* sidewall holes
22*c*, 24*c*, 34*e*, 144*a*, 152*a*, 222*c*, 224*e* through-hole
24, 100, 110, 120, 140, 150 filter
24*a* element
24*b*, 146, 156 resource collection hole
26, 26*a*, 26*b* gas collection pipe
28, 28*a*, 28*b* oil collection pipe
30 gas storage chamber
32 oil storage chamber
34, 224 gate pipe
34*a*, 224*a* outer gate pipe
34*b*, 224*b* inner gate pipe
36 storage tank
38*a*, 38*b*, 38*c*, 38*d* upper pipe
40*a*, 40*b*, 40*c*, 40*d* lower pipe
42 center pipe
42*a* cooling water supply pipe
42*b* cooling water recovery pipe

42*c* air supply pipe
42*d* exhaust gas recovery pipe
42*e* piping housing pipe
42*f* wiring housing pipe
44, 226 secondary protective pipe
44*a*, 48*c* secondary sidewall
44*b*, 48*d* secondary sidewall hole
44*c*, 46*c*, 48*e* secondary through-hole
46 secondary filter
46*a* secondary element
46*b* secondary resource collection hole
48, 228 secondary gate pipe
48*a* secondary outer gate pipe
48*b* secondary inner gate pipe
50, 50*a*, 50*b* secondary gas collection pipe
52, 52*a*, 52*b* secondary oil collection pipe
54 secondary gas storage chamber
56 secondary oil storage chamber
58*a* filter fixing plate
58*b* center guide plate
58*c* outer guide plate
58*d* inner guide plate
60 coiled tubing device
62 reel
64 letting-out device
66*a* fuel gas
66*b* air
66*c* foaming material
66*d* conductive particle
68*a* fuel gas supply pipe
68*b* air supply pipe
68*c* foaming material liquid concentrate supply pipe
68*d* conductive particle supply pipe
68*e* high-pressure water supply pipe
68*f* high-pressure air supply pipe
68*g* ignition wire
70 tube outer wall
72 opening
74 mixing chamber
80 crushed particle
82 cement particle
84 slow-acting heat generating body
86 expanding body
88 fast-acting heat generating body
90 sediment discharging device
112, 124 electromagnet coil
122 permanent magnet
130 demagnetizing means
132 operation section
134 main body
136 permanent magnet
138 target object
142, 152 spiral metal wire
144, 154 column
160 circulating-flow generation device
162, 230 circulating flow generation pipe
164 high-frequency heater
166, 168 movable pipe
170 steam jetting section
170*a*, 170*b* steam jetting hole
172, 174 spiral rotary wing
180 jet turbine
182 compressing section
184, 194 combustion chamber
186 turbine
188 power generating means
190 submerged burner
192 nozzle
196 combustion stabilizer
198 ignition device
200 fuel cell
202 fuel pole
204 electrolyte layer
206 air pole
222*a*, 224*c* bottom wall
222*b*, 224*d* bottom wall hole

The invention claimed is:

1. A resource collection system comprising:

a resource collection pipe for sending resources collected from a seabed layer to a collected resource storage tank;

a protective pipe that is provided around the resource collection pipe and protects the resource collection pipe; and a coiled tubing device that is let out from a winding reel disposed on a sea surface or an inside of the protective pipe and extends from an inner side to an outer side piercing through a sidewall of the protective pipe, wherein the resource collection system crushes the seabed layer by supplying liquid concentrates of a foaming material, fuel gas, and air including oxygen into the seabed layer through the coiled tubing device, or supplying the liquid concentrates of the foaming material, a fuel gas generation material, high-pressure water, and the air into the seabed layer through the coiled tubing device, and generating fuel gas with chemical reaction of the fuel gas generation material and the high-pressure water or with decomposition promotion of the seabed layer by the fuel gas generation material, mixing the liquid concentrates of the foaming material with one another to cause the liquid concentrates to foam in an atmosphere including the fuel gas and the air, and explosively burning the fuel gas accumulated in a cavity of the foaming material.

2. The resource collection system according to claim 1, wherein the coiled tubing device includes a tubular tube outer wall, an opening provided in the tube outer wall, and a mixing chamber provided on an inner side of the opening, and, after mixing the liquid concentrates of the foaming material with one another in the mixing chamber, supplies a mixture of the liquid concentrates to between the seabed layer and the tube outer wall through the opening together with the fuel gas and the air.

3. The resource collection system according to claim 2, wherein the foaming material formed by mixing the liquid concentrates of the foaming material with one another includes conductor metal or a carbon nanotube, and the resource collection system ignites the fuel gas accumulated in the cavity of the foaming material by applying a high voltage to between the foaming material having conductivity and an ignition wire exposed to the tube outer wall or the mixing chamber and electrically insulated.

4. The resource collection system according to claim 2, wherein the resource collection system ignites the fuel gas accumulated in the cavity of the foaming material by applying a high voltage to an ignition plug provided in the tube outer wall or the mixing chamber.

5. The resource collection system according to claim 2, wherein the resource collection system cleans the mixing chamber using at least one of high-pressure water and high-pressure air.

6. The resource collection system according to claim 1, wherein a plurality of the coiled tubing devices are disposed in at least one position with respect to an axial direction of the protective pipe at a predetermined interval in a circumferential direction of the positions.

7. The resource collection system according to claim 1, wherein the fuel gas generation material is carbide particles, the fuel gas is acetylene gas; and the acetylene gas is generated with chemical reaction of the carbide particles and the high-pressure water.

8. The resource collection system according to claim 1, wherein the fuel gas generation material is methanol, the seabed layer is a methane-hydrate layer, the fuel gas is methane gas, and the methane gas is generated with decomposition promotion of the methane-hydrate layer by the methanol.

9. A resource collection system comprising:

a high-pressure water supply pipe for supplying high-pressure water into a seabed layer in order to collect resources from the seabed layer; and a resource collection pipe for sending the resources collected from the seabed layer to a collected resource storage tank, wherein the resource collection system mixes a crushed particle in the high-pressure water in the high-pressure water supply pipe and crushes the seabed layer with the high-pressure water mixed with the crushed particle, the crushed particle is obtained by coating an outer side of a cement particle with a slow-acting heat generating body, an expanding body, and a fast-acting heat generating body in order, the slow-acting heat generating body is obtained by baking, with a microwave, a material that absorbs moisture of the high-pressure water and generates heat, the expanding body is formed by a material that absorbs the moisture of the high-pressure water and expands, and the fast-acting heat generating body is obtained by baking, with the microwave, a same material as the slow-acting heat generating body for a shorter time than the slow-acting heat generating body or not baking the material with the microwave.

10. A resource collection system comprising:

a resource collection pipe for sending resources collected from a seabed layer to a collected resource storage tank;

a protective pipe that includes a sidewall provided around the resource collection pipe and a plurality of sidewall holes piercing through the sidewall and protects the resource collection pipe;

a filter that is disposed on an inside of the protective pipe and removes sediment excavated from the seabed layer; and a gate pipe disposed at least one of on an outer side of the protective pipe and between the protective pipe and the filter in order to open and close the plurality of sidewall holes, wherein the resource collection system opens the plurality of sidewall holes when collecting the resources from the seabed layer and closes the plurality of sidewall holes at times other than when collecting the resources, and the resource collection system prevents freezing of seawater between the protective pipe and the gate pipe and in the plurality of sidewall holes by feeding high-pressure hot water or high-pressure steam into at least one of a through-hole or a spiral through-hole in an axial direction of the sidewall of the protective pipe and a through-hole or a spiral through-hole in an axial direction of a sidewall of the gate pipe.

11. The resource collection system according to claim 10, wherein the resource collection system opens the plurality of sidewall holes after raising pressure on the inner side of the protective pipe to a same pressure as pressure of the seabed layer on n the outer side of the protective pipe.

12. The resource collection system according to claim 10, wherein a coating agent is mixed in the high-pressure water and, in a state in which the plurality of sidewall holes are closed, the resource collection system coats the filter by feeding the high-pressure water mixed with the coating agent in a same direction as a direction in which the resources flow in the filter when the resources are collected.

13. The resource collection system according to claim 10, wherein, in a state in which the plurality of sidewall holes are closed, the resource collection system cleans an inside of the filter by feeding the high-pressure water in an opposite direction of a direction in which the resources flow in the filter when the resources are collected.

14. The resource collection system according to claim 13, wherein, in a state in which the plurality of sidewall holes are closed, the resource collection system cleans a surface of the filter by feeding high-pressure hot water or high-pressure steam to the surface of the filter.

15. The resource collection system according to claim 10, further comprising:

a secondary protective pipe including a secondary sidewall disposed on an inner side of the filter and a plurality of secondary sidewall holes piercing through the secondary sidewall;

a secondary filter that is disposed on an inside of the secondary protective pipe and removes sediment excavated from the seabed layer; and a secondary gate pipe disposed at least one of between the filter and the secondary protective pipe and between the secondary protective pipe and the secondary filter in order to open and close the plurality of secondary sidewall holes.

16. The resource collection system according to claim 10, wherein the protective pipe includes a semispherical bottom wall extending from one end of the sidewall and a plurality of bottom wall holes piercing through the bottom wall.

17. A resource collection system comprising:

a resource collection pipe for sending resources collected from a seabed layer to a collected resource storage tank;

a protective pipe that is provided around the resource collection pipe and protects the resource collection pipe; and a coiled tubing device let out from a winding reel disposed on a sea surface or on an inside of the protective pipe and extending from an inner side to an outer side piercing through a sidewall of the protective pipe, wherein the coiled tubing device includes:

a sub resource collection pipe for sending the resources collected from the seabed layer to the resource collection pipe;

a sub protective pipe that includes a sub sidewall provided around the sub resource collection pipe and a plurality of sub sidewall holes piercing through the sub sidewall and protects the sub resource collection pipe;

a sub filter that is disposed on an inside of the sub protective pipe and removes sediment excavated from the seabed layer; and a sub gate pipe disposed at least one of on an outer side of the sub protective pipe and between the sub protective pipe and the sub filter in order to open and close the plurality of sub sidewall holes.

18. A resource collection system comprising:

a resource collection pipe for sending resources collected from a seabed layer to a collected resource storage tank;

a protective pipe that is provided around the resource collection pipe and protects the resource collection pipe; and a filter that is disposed on an inside of the protective pipe and removes sediment excavated from the seabed layer, wherein the filter includes a permanent magnet disposed to hold diatomaceous earth with magnetic body powder on an inside of an element and demagnetizing means for weakening a holding force for the diatomaceous earth with magnetic body powder by the permanent magnet, and the resource collection system reduces an amount of the diatomaceous earth with magnetic body powder held by the permanent magnet by actuating the demagnetizing means; and wherein the demagnetizing means is an electromagnet coil disposed on an inner side or an outer side of the permanent magnet such that poles opposite to poles of the permanent magnet are respectively adjacent to the poles, and the resource collection system reduces the amount of the diatomaceous earth with magnetic body powder held by the permanent magnet by energizing the electromagnet coil.

19. The resource collection system according to claim 18, wherein the resource collection system further has at least one of the following configurations (1) to (9):

(1) the resource collection system pushes out, using a high-pressure pump, the sediment removed by the filter from an opening of a sidewall of the protective pipe toward the seabed layer;

(2) the protective pipe is disposed with an axial direction directed vertically with respect the resource collection pipe includes a gas collection pipe connected to a gas storage chamber provided above the filter and an oil collection pipe connected to an oil storage chamber provided below the filter, the filter includes a resource collection hole piercing through the filter in a longitudinal direction, and among the resources having passed through the filter from an outer side toward an inner side and reached the resource collection hole, the resource collection system raises gas to the gas storage chamber and drops oil to the oil storage chamber;

(3) the filter includes a plurality of columnar elements, and the elements are disposed in at least one position with respect to a longitudinal direction at a predetermined interval in a circumferential direction of the positions;

(4) the resource collection system prevents freezing of seawater on a surface or an inside of the filter by feeding high-pressure hot water or high-pressure steam into a through-hole in a longitudinal direction of the filter;

(5) the filter includes an electromagnet coil disposed to hold diatomaceous earth with magnetic body powder on an inside of an element, and the resource collection system generates a holding force for the diatomaceous earth with magnetic body powder by the electromagnet coil by energizing the electromagnet coil;

(6) the filter includes a spiral metal wire and a column extending in a straight-axis direction of the spiral metal wire and fixed to the spiral metal wire, and the resource collection system prevents freezing of seawater on a surface of the spiral metal wire by feeding high-pressure hot water or high-pressure steam into a through-hole or a spiral through-hole of the spiral metal wire in a longitudinal direction of the column;

(7) the resource collection system prevents freezing of seawater on a surface and an inside of the filter by applying high-pressure hot water or high-pressure steam to the surface of the filter;

(8) the resource collection system prevents freezing of seawater on a surface and an inside of the filter by transferring heat of high-pressure hot water or high-pressure steam to the filter through heat transfer means at both ends in a longitudinal direction of the filter;

(9) the filter includes an object obtained by stacking and compressing fiber-like metal entangled like cotton, and the resource collection system prevents freezing of seawater on a surface and an inside of the filter by feeding high-pressure hot water or high-pressure steam into a through-hole in a longitudinal direction of the filter.

20. A resource collection system comprising:

a resource collection pipe for sending resources collected from a seabed layer to a collected resource storage tank;

a protective pipe that is provided around the resource collection pipe and protects the resource collection pipe;

a circulating flow generation pipe that is provided in a U shape on an inside of the protective pipe and generates a circulating flow between the seabed layer and the protective pipe; and a power supply device that supplies electric power to a high-frequency heater disposed halfway in the circulating flow generation pipe, wherein the resource collection system further has at least one of the following configurations (1) to (6):

(1) the power supply device includes a jet turbine, and the jet turbine is driven by combustion gas generated by burning the resources collected from the seabed layer in a combustion chamber and supplies high-pressure hot water or high-pressure steam to the circulating flow generation pipe;

(2) the power supply device includes a turbine, and the turbine is driven by combustion gas and steam generated by burning, with a submerged burner, the resources collected from the seabed layer and supplies high-pressure hot water or high-pressure steam to the circulating flow generation pipe;

(3) the power supply device is a fuel cell that supplies electric power using hydrogen obtained by causing the resources collected from the seabed layer and high-temperature steam to react;

(4) when an amount of the resources collected from the seabed layer decreases, the resource collection system short-circuits a channel of the circulating flow by changing an angle of movable pipes provided at both ends of the circulating flow generation pipe and jets high-pressure hot water or high-pressure steam from the movable pipes toward the seabed layer;

(5) when a flow rate of the circulating flow decreases, the resource collection system moves sediment in the circulating flow generation pipe in a direction of the circulating flow by rotating a spiral rotary wing;

(6) the power supply device is a thermoelectric conversion device that converts heat of a hydrothermal deposit in the seabed layer into electric power and supplies the electric power.

21. The resource collection system according to claim 20, wherein in the configuration (4) or (5), before moving the protective pipe in an axial direction with respect to the seabed layer, the resource collection system supplies cement particles into the seabed layer in two opening positions of the circulating flow generation pipe.

* * * * *